US009770069B2

(12) United States Patent
Munns et al.

(10) Patent No.: US 9,770,069 B2
(45) Date of Patent: Sep. 26, 2017

(54) ATTACHMENT SYSTEM FOR SECURING FOOTWEAR

(71) Applicant: Fox Head, Inc., Irvine, CA (US)

(72) Inventors: Jon Munns, Portland, OR (US); Brian Sanderson, Hurricane, UT (US); Bryan Christopher Worth, Irvine, CA (US)

(73) Assignee: FOX HEAD, INC., Irvine, CA (US)

( * ) Notice: Subject to any disclaimer, the term of this patent is extended or adjusted under 35 U.S.C. 154(b) by 0 days.

(21) Appl. No.: 14/763,419

(22) PCT Filed: Jan. 28, 2014

(86) PCT No.: PCT/US2014/013438

§ 371 (c)(1),
(2) Date: Jul. 24, 2015

(87) PCT Pub. No.: WO2014/117178

PCT Pub. Date: Jul. 31, 2014

(65) Prior Publication Data

US 2015/0359298 A1 Dec. 17, 2015

Related U.S. Application Data

(60) Provisional application No. 61/757,650, filed on Jan. 28, 2013, provisional application No. 61/839,316, filed on Jun. 25, 2013.

(51) Int. Cl.
*A43C 11/14* (2006.01)
*A43B 5/14* (2006.01)

(52) U.S. Cl.
CPC ..... *A43C 11/1473* (2013.01); *A43B 5/145* (2013.01); *A43C 11/1406* (2013.01); *A43C 11/146* (2013.01); *Y10T 24/2183* (2015.01)

(58) Field of Classification Search
CPC ..... A43C 11/1473; A43C 11/1406; A43C 11/146; A43B 5/145; Y10T 24/2183; Y10T 24/216
(Continued)

(56) References Cited

U.S. PATENT DOCUMENTS 3,654,670 A 4/1972 Baso
3,818,547 A 6/1974 Baso
(Continued)

FOREIGN PATENT DOCUMENTS

EP 1 205 122 A2 5/2015
FR 2966020 A3 4/2012

OTHER PUBLICATIONS

Search Report and Written Opinion dated May 16, 2014 in International Application No. PCT/US2014/013438, 13 pages.
(Continued)

*Primary Examiner* — Jameson Collier
*Assistant Examiner* — Heather Mangine
(74) *Attorney, Agent, or Firm* — Foley & Lardner LLP

(57) ABSTRACT

An attachment system for securing footwear to a wearer, the attachment system including a buckle assembly and a receiver. The buckle assembly may include a clasp adapted to be coupled to a first portion of a footwear upper. The clasp may have an elongated portion with a first pivotable surface. The receiver may be adapted to be coupled to a second portion of the footwear upper. The receiver may have an elongated recess adapted to slideably receive the elongated portion, and the receiver may have a second pivotable surface that is sufficiently complementary shaped to the first surface so that the surfaces pivotably engage each other in a transverse direction of the attachment system when the buckle assembly is locked in the receiver.

17 Claims, 33 Drawing Sheets

(58) Field of Classification Search
USPC ..... 36/50.1, 50.5
See application file for complete search history.

(56) References Cited

U.S. PATENT DOCUMENTS

| | | | | |
|---|---|---|---|---|
| 4,051,611 | A | 10/1977 | Chalmers | |
| 4,121,359 | A | 10/1978 | Bertetto et al. | |
| 4,253,250 | A * | 3/1981 | Weigl | A43C 7/08 24/130 |
| 4,575,958 | A * | 3/1986 | Arieh | A43B 5/0456 36/105 |
| 4,979,760 | A | 12/1990 | Derrah | |
| 5,237,759 | A | 8/1993 | Chaigne | |
| 5,251,388 | A | 10/1993 | Pozzobon et al. | |
| 6,324,735 | B1 | 12/2001 | Chen | |
| 6,347,436 | B1 | 2/2002 | Barber et al. | |
| 6,532,687 | B2 | 3/2003 | Towns et al. | |
| 6,609,276 | B1 | 8/2003 | Lin | |
| 6,622,400 | B2 | 9/2003 | Bollard | |
| 6,640,396 | B1 | 11/2003 | Lin | |
| 7,530,182 | B2 | 5/2009 | Munns | |
| 7,603,795 | B2 | 10/2009 | Pallatin | |
| 7,866,065 | B2 | 1/2011 | Munns | |
| 2002/0078596 | A1 | 6/2002 | Towns et al. | |
| 2002/0095821 | A1 | 7/2002 | Bollard | |
| 2006/0207126 | A1 | 9/2006 | Pallatin | |
| 2007/0101615 | A1 | 5/2007 | Munns | |
| 2011/0094071 | A1 | 4/2011 | Veldhoen | |

OTHER PUBLICATIONS http://www.dirtrider.com/features/online-exclusives/141_1201_fox_instinct_boot_intro Denison, Chirs. "Fox Instinct Boot Intro—Dirt Rider Magazine." Dirt Rider. Dirt Rider, Jan. 26, 2012. Web. Jan. 30, 2017.

http://www.motorcycle-usa.com/2012/01/article/fox-racing-instinct-boot-review/ Waheed, Adam. "Fox Racing Instinct Boot Review." MotoUSA.com. MotoUSA.com, Jan. 31, 2012. Web. Jan. 30, 2017.

https://www.youtube.com/watch?v=1J6bXFoA_v8 Fox Racing. "Instinct Boot Launch Party." Online video clip. You Tube. You Tube, Feb. 7, 2012. Web. Jan. 30, 2017.

https://www.youtube.com/watch?v=R4P1afV5JG0 Curlys Motocross's Channel. "New Fox Instinct Boot Interview." Online video clip. You Tube. YouTube, Feb. 21, 2012. Web. Jan. 30, 2017.

https://www.youtube.com/watch?v=ZOlflkgg844 GrindTV. "Fox Instinct Boot Intro." TransWorld MOTOcross. Online video clip. You Tube. You Tube, Jan. 30, 2012. Web. Jan. 30, 2017.

* cited by examiner

ATTACHMENT SYSTEM FOR SECURING FOOTWEAR

RELATED APPLICATIONS

This application claims the benefit of and priority to U.S. Provisional Application Ser. No. 61/757,650, filed Jan. 28, 2013, and U.S. Provisional Application Ser. No. 61/839,316, filed Jun. 25, 2013, the contents of which are hereby incorporated by reference as if recited in full herein for all purposes.

BACKGROUND

The inventive subject matter pertains, generally but not exclusively, to an attachment system that secures an item of footwear to the wearer's feet and legs. In particular embodiments, the attachment system relates to boots, for example, as used in motocross sports.

The upper of motocross boots usually comprise two portions or flaps that overlap each other and that are secured to each other when the boot is worn. The two portions are usually secured by a buckle-type fastener. An example of an attachment system for securing boots to a rider's feet and legs and generally showing a boot configured for use in motorcycle sports is described in U.S. Pat. No. 7,866,065, which is hereby incorporated by references in its entirety for all purposes.

There are several problems associated with conventional attachment systems. For example, the alignment of the buckle assembly and receiver is often somewhat off due to variations in fit or environmental conditions, such as dirt getting caught in the mechanism, thereby interfering with the effectiveness of the system and overall fit of the boot.

Some prior art patents describe multi-part buckle assemblies that allow some movement between boot portions. For example, U.S. Pat. No. 3,818,547 and U.S. Pat. No. 3,654,670 describe a buckle assembly for ski boots. U.S. Pat. No. 3,818,547 describes a buckle assembly with a tension lever interacting with a row of teeth. The tension lever is hingedly coupled to a swivel plate which forms an extension of the tension lever. U.S. Pat. No. 3,654,670 describes a clamping loop that interacts with a toothed tensioning lever. The tension lever is coupled to a clamping loop that swings freely with an adjustable plate, which in turn is coupled to an instep portion of a boot. Another example of an adjustable tightening device is described in U.S. Pat. No. 6,622,400. The device allows for a transverse movement between a cap and a base plate. Another example of a tensioning/release mechanism for a buckle device of a skate is described in U.S. Pat. No. 6,640,396. The strap may be adjusted for tightness when the release arm is in the closed position. Pivotal movement of release arm relative to the base is limited by a push member. Some attempts have been made to align parts of the attachment system with magnetic fasteners, such as described in U.S. Pat. No. 6,532,687. These magnetic fasteners, however, provide insufficient tensioning for boot portions.

In the known systems, however, dirt and debris can accumulate in the gaps and spaces around the individual parts leading to misalignment of the parts and making the system prone to damage. Additionally, misalignment of the parts can create pressure points in the boot that cause the wearer to experience some discomfort. Furthermore, the system often includes numerous parts which makes the overall system rather bulky.

Accordingly there is a need for an improved attachment system wherein the attachment system has a low and sleek profile that reduces pressure point discomfort, wherein the buckle parts are aligned to provide a strong and reliable connection between two portions while allowing movability between the parts in the transverse direction to prevent debris from interfering with the functioning of the system, wherein the system is ergonomically designed, and wherein the construction of the attachment system is efficient and cost-effective.

BRIEF DESCRIPTION OF THE DRAWINGS

The following figures show embodiments according to the inventive subject matter, unless noted as showing prior art.

DETAILED DESCRIPTION

Figure 1:
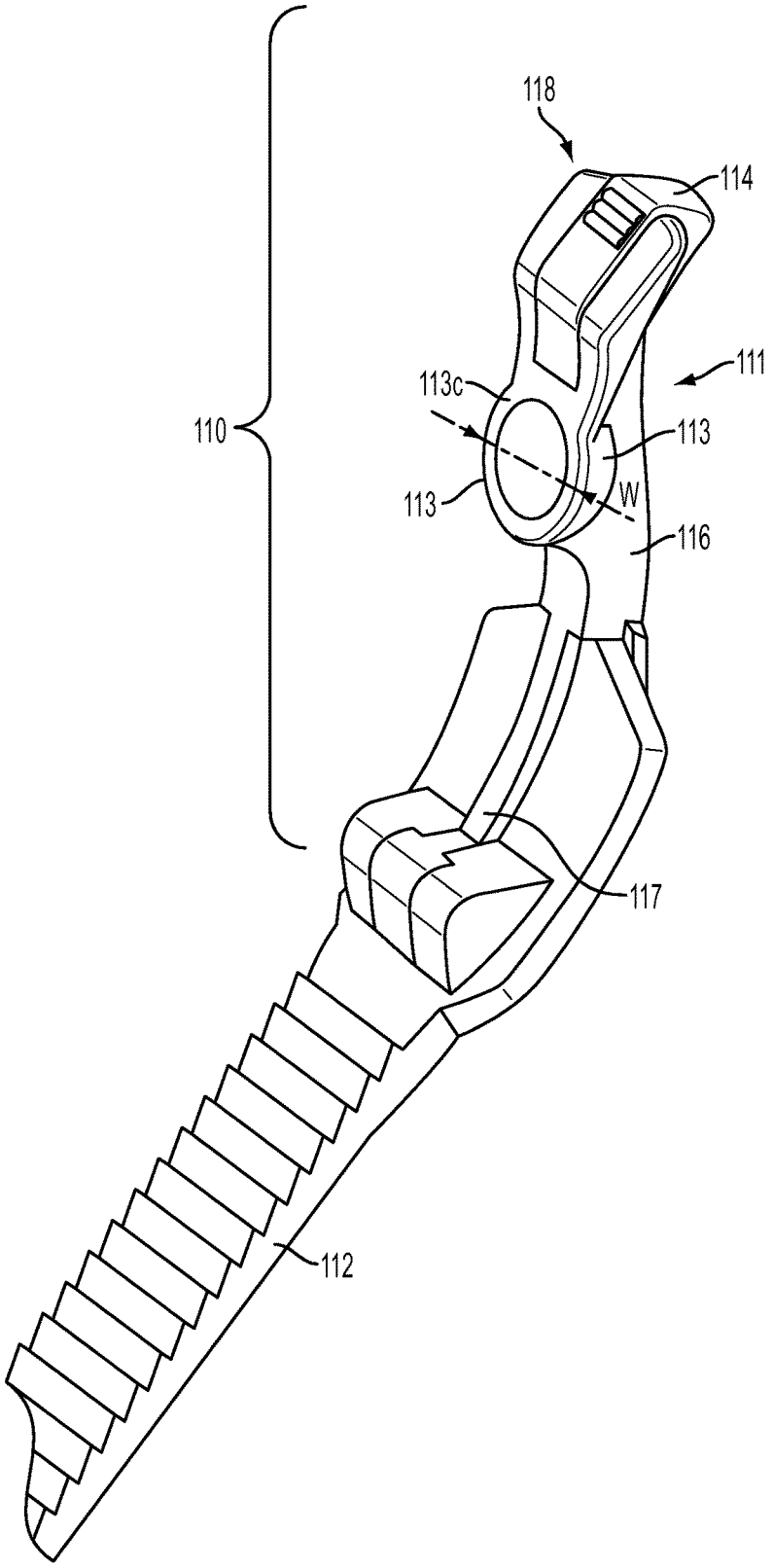
FIG. 1 shows a perspective view of a buckle assembly with parts in grey and red colors, and attached to a buckle strap shown in black.
Figure 2:
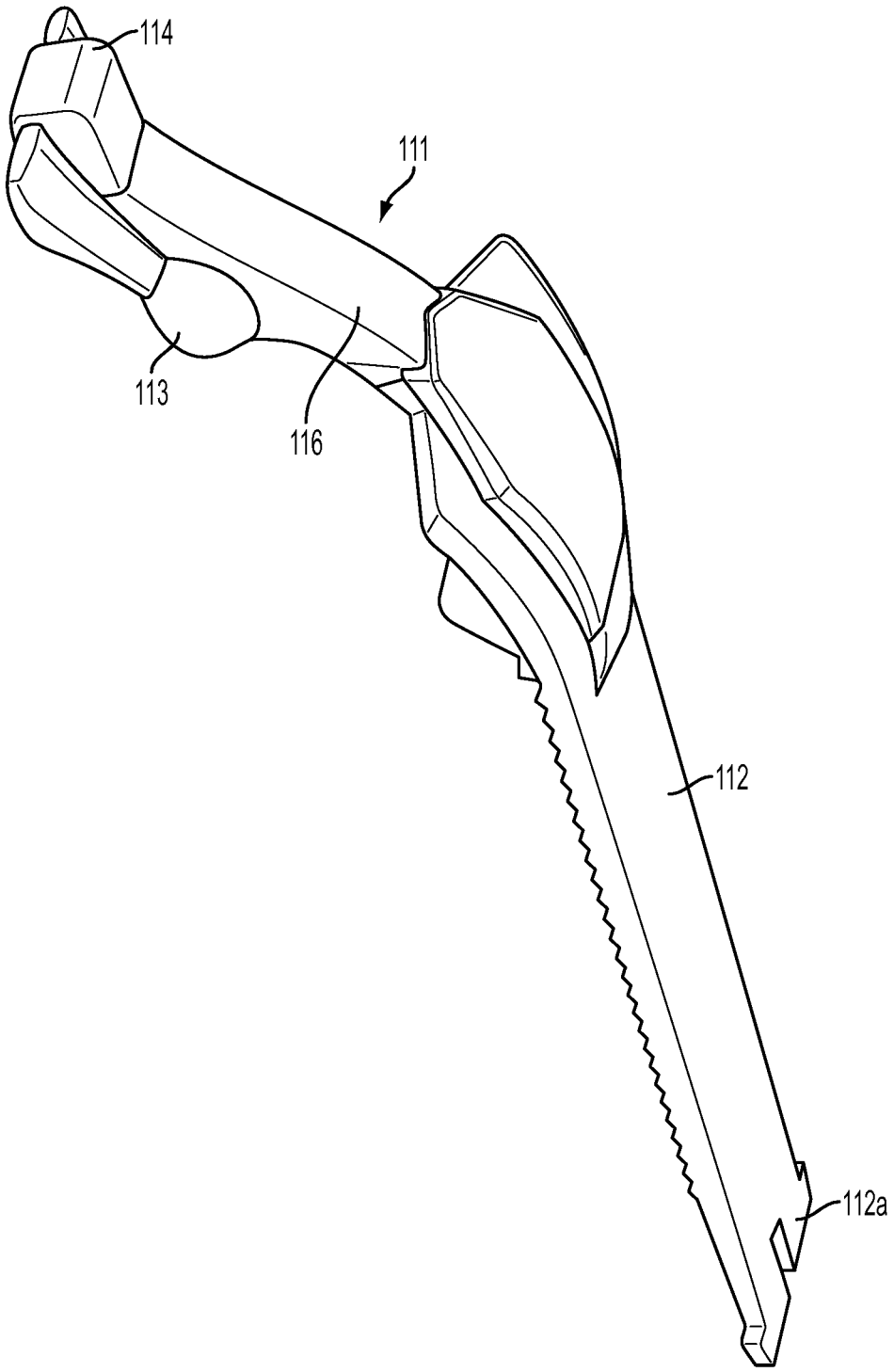
FIG. 2 shows a perspective view along the bottom of the buckle assembly and the strap.

Representative embodiments according to the inventive subject matter are shown in FIGS. 1-33, wherein the same or generally similar features share common indications.

The inventive subject matter is directed to an attachment system (e.g., systems 100, 200) that secures two parts together. The attachment system may be configured for use with any other type of footwear, though it may be particularly useful with protective footwear intended for use with a motorized or non-motorized vehicle, (e.g., motocross boot, or other sports, e.g.) or as ski boots or skates, where opposing portions of an upper need to be pulled tightly together.

The inventive subject matter secures boots to the wearer's feet and legs. In particular, the attachment system may secure the upper portions of sports boots, such as motocross boots.

The attachment system may have two parts, for example, a buckle assembly 110 coupled to a first flap of the boot 10, and a receiver 120 coupled to a second portion of the boot. The buckle assembly 110 may include a clasp 111 and a buckle strap 112. The buckle strap 112 may have a fixed end 112*a* attached to a first portion of the boot upper. The receiver 120 may be attached to the second portion of the boot upper by an anchor 121 and fasteners, as explained in connection with the system 200, a fastener can define an anchor engagement portion of an anchor member 220.

Figure 5:
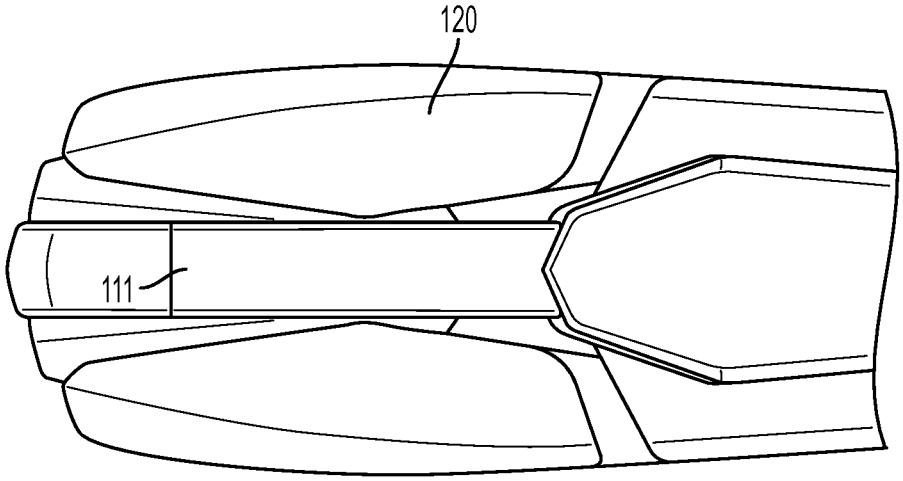
FIG. 5 shows a top view of the engagement of a receiver and a clasp.

Upon closing of the attachment system, a user engages the clasp 111 and the receiver 120 by sliding the clasp 111 in a recess 121 or indentation in the receiver. The clasp 111 and receiver 120 include a pivot point, e.g. first pivotable surface 113 pivotably engaged in a second pivotable surface 123, that allows the clasp to engage the receiver. The user pulls the clasp 111 and/or the receiver 120 forward so that the receiver pivots into a closed position and secures the buckle assembly in the locked down position (FIG. 5). The two portions of the boot 10 are pulled together, tightening the portions of the boot upper 11 against the wearer's leg. The pivoting movement of the clasp 111 allows for an adjustment of the clasp along the boot upper relative to the receiver, thereby allowing for an automatic natural alignment of the strap 112 and providing some relative movement between the two portions of the upper. It also allows the boot to shift dynamically with the natural movement of the user's leg and foot while allowing the boot to remain secured on the leg and foot. Additionally, by allowing movement between the two parts in the transverse directions of the attachment system, the risk of debris or dirt interfering with the functioning of the system is minimized.

As used herein the "transverse direction" of the attachment system refers to a direction generally along the width of the system. This direction may generally be perpendicular to the longitudinal tensioning direction L of the system or could be at an angle relative to the longitudinal direction L. The clasp 111 may be able to move relative to the receiver 120 in both left and right transverse directions, for example angling outward from a longitudinal axis of the system or a central axis of the first pivotable surface.

The clasp 111 may have a grip 114 at a first free end of the clasp, and a buckle strap 112 coupled to the other end 117 of the clasp. The clasp 111 may have an elongated portion 116, a first pivotable surface 113, and a portion 117 for coupling to the strap.

The receiver 120 may have an elongated recess 127 and a second pivotable surface 123. The elongated recess 127 may be adapted to slideably receive the elongated portion 116 of the clasp 111. The second pivotable surface 123 of the receiver 120 is sufficiently complementary shaped to the first surface 113 so that the first and second pivotable surfaces engage each other. The interaction between the first and second pivotable surfaces 113, 123 allows relative movement between the clasp 111 and receiver 120 in both transverse directions of the attachment system 100 when the attachment system is in the closed position, that is when the buckle assembly 110 is locked down in the receiver 120 and the first and second portions of the boot upper are secured relative to each other in the longitudinal direction L of the attachment system.

Another advantage of the system is the ease of release of the attachment system. The clasp 111 can be released by one hand. By lifting the free end 118 of the clasp upward, the receiver 120 moves upward as well and flips backward thereby releasing tension and allowing the clasp 111 to be removed from the receiver in a single movement.

A closed and locked buckle that is fully engaged with the buckle anchor offers a secure attachment that resists accidental opening due to vibration, jarring, or physical impact. The closed attachment system has an overall sleek and low profile that is contoured to follow a curved line of the footwear. The buckle assembly allows a one-step release action. The ergonomic grip 114 at the free end 118 of the clasp 111 allows a user to release the clasp from the anchor base with one action. A wearer may open a closed system by pulling the grip away from the anchor base 121*a*. Releasing the clasp will pull up the receiver as well. The receiver 120 rotates backward along an anchor pin 124. Within the same action, during the follow-through, the clasp 111 is automatically decoupled from the buckle lever.

In one possible embodiment, a clasp 111 with a pivot point 113 allows the clasp to pivotably float in or on the receiver 120 on the strap 112. In some embodiments, surfaces on the clasp 111 may have sufficiently complementary shapes so as to allow pivoting or sliding movements along one or more axes. For example, a ball and cup arrangement wherein a ball-shaped element of the clasp 111 fits into a cup-like recess of the receiver, allowing the buckle to move relative to the receiver in a transverse direction. As a result of this moveable clasp, a front part of the boot, for example a shin guard, may also be allowed to move relative to the rest of the boot. The freedom of motion of the clasp within the receiver is illustrated with arrows 20 in FIG. 6.

Figure 6:
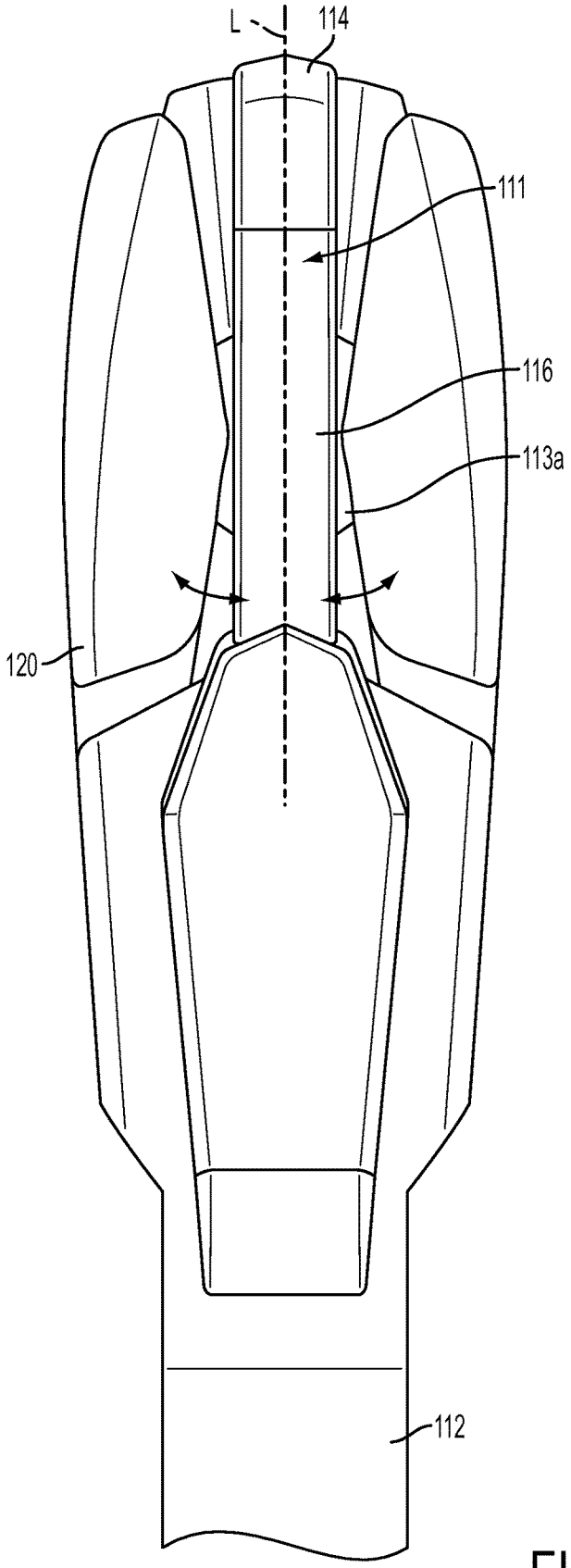
FIG. 6 shows another top view of the clasp, and receiver arranged as in FIG. 5, and indicating by arrows the pivotability of the clasp in the receiver.
Figure 11:
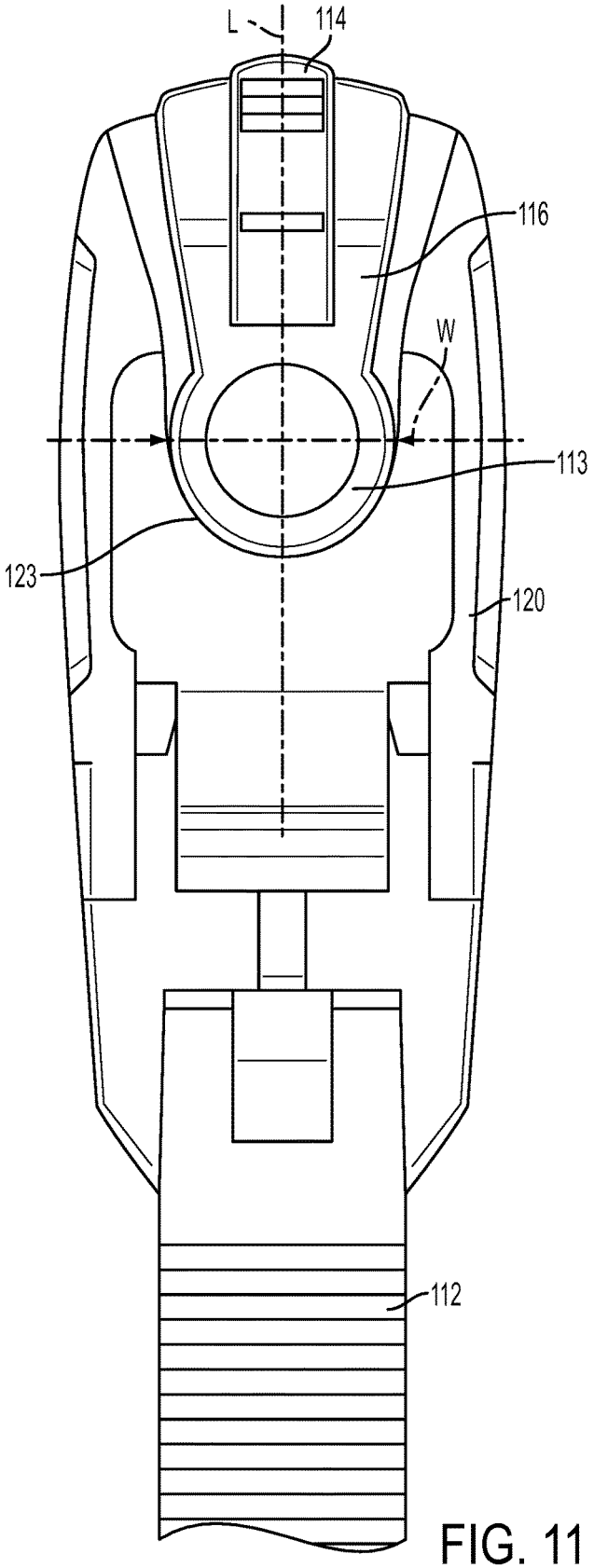
FIG. 11 shows a bottom view of the receiver and clasp in the closed position (without base).
Figure 12:
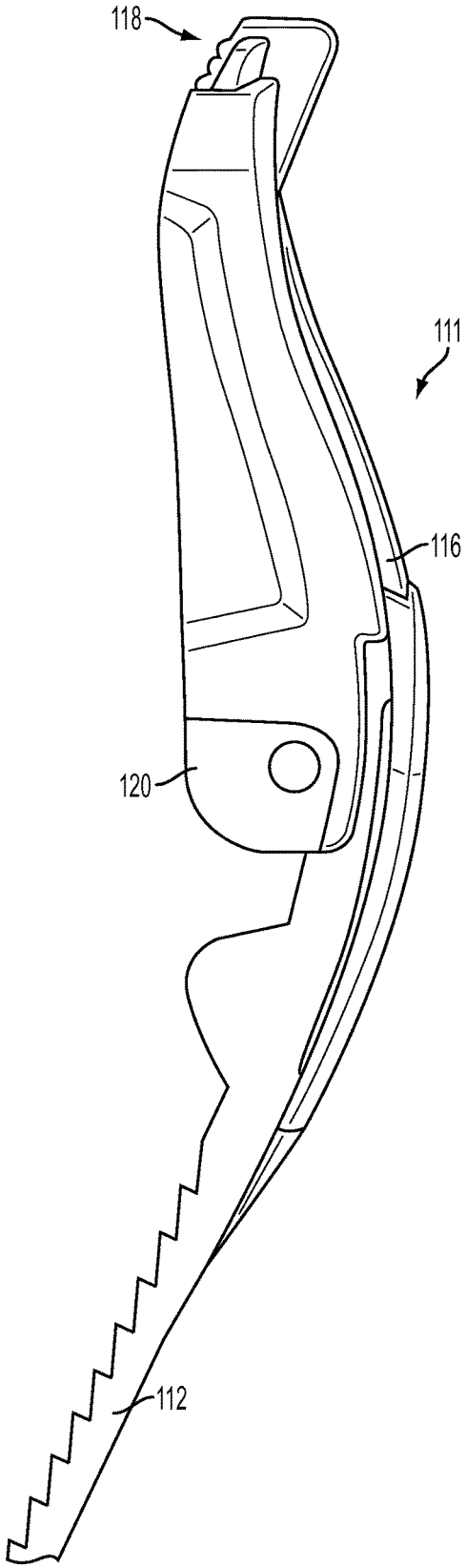
FIG. 12 shows a side view of clasp, strap, and receiver in the closed position.
Figure 13:
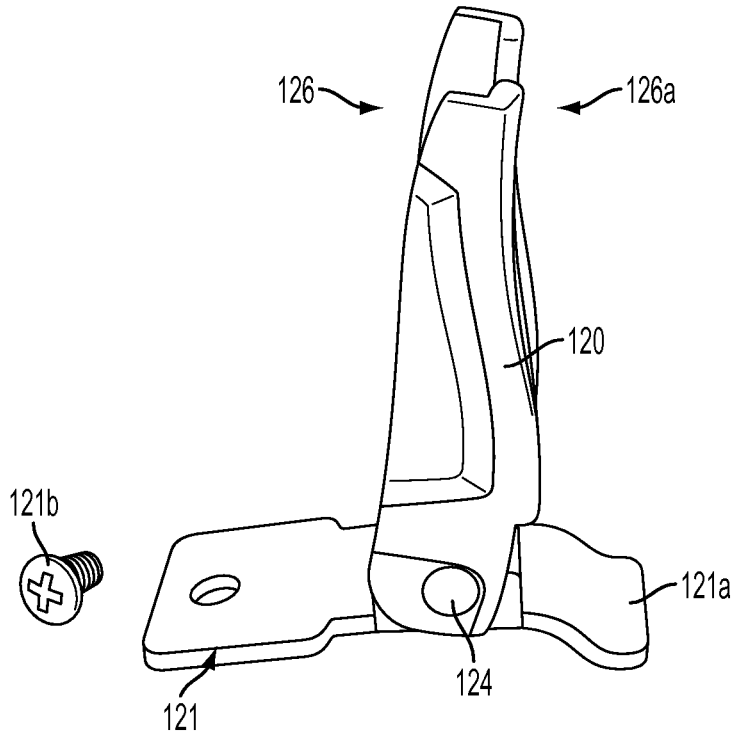
FIGS. 13-18 show additional views of the receiver and anchor.
Figure 14:
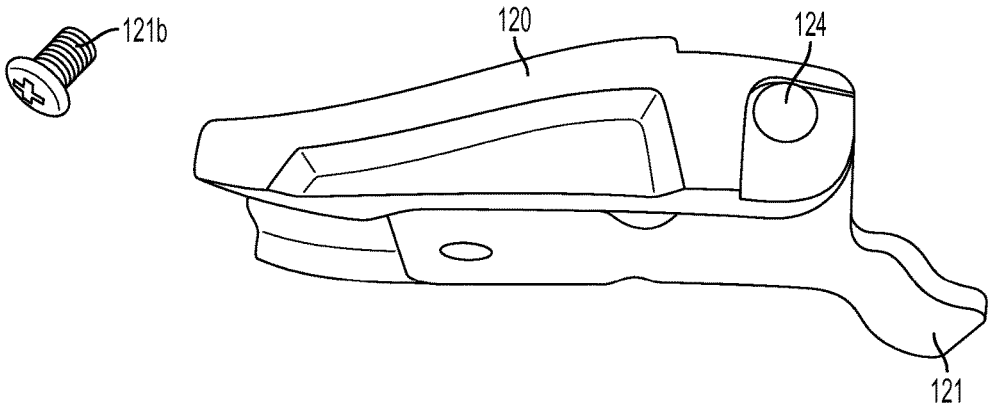
Figure 15:
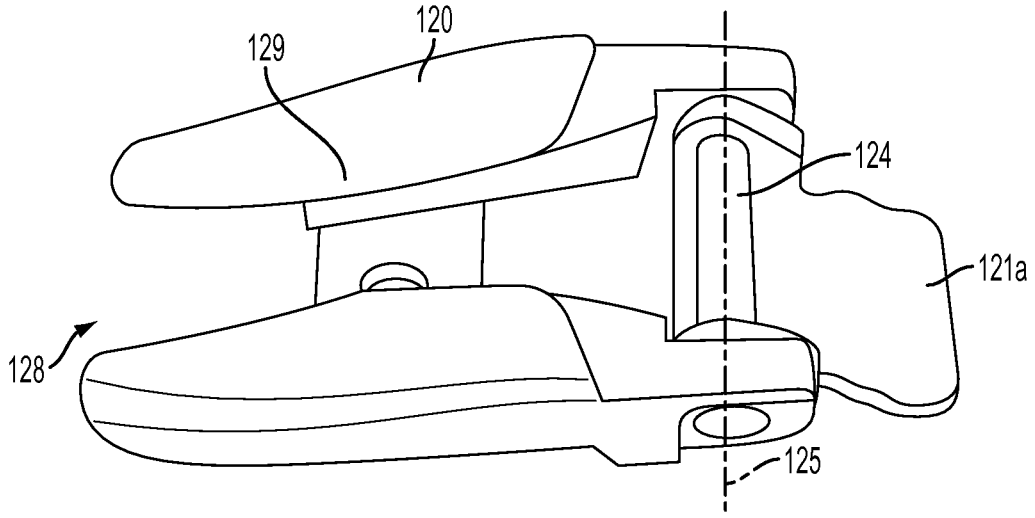
Figure 16:
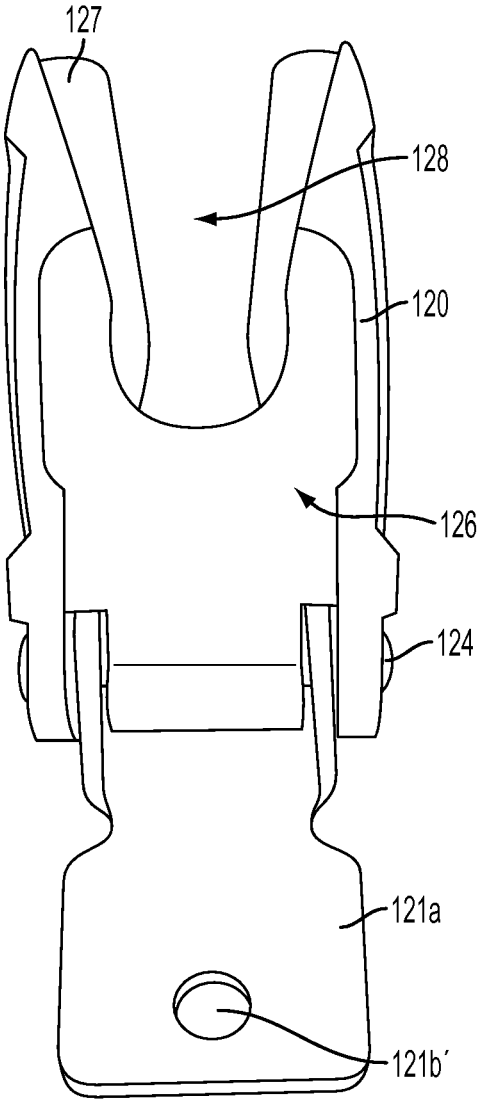
Figure 17:
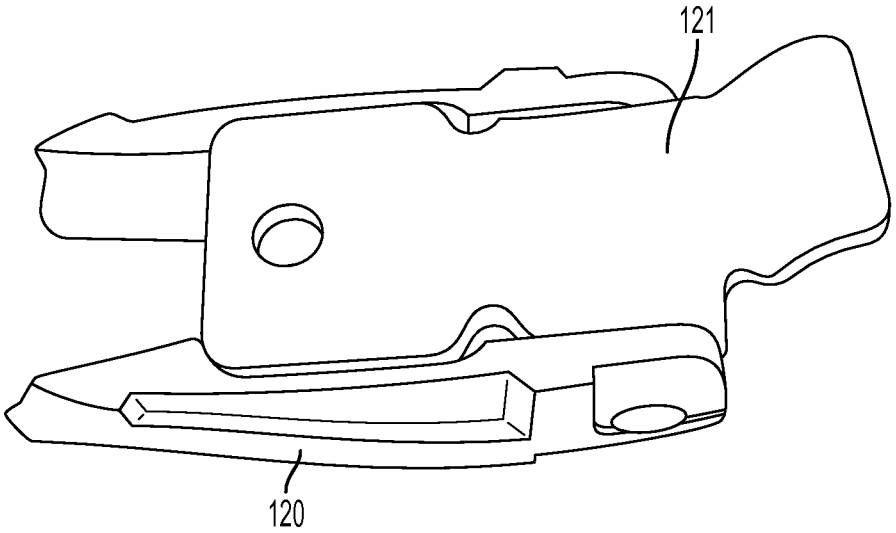
Figure 18:
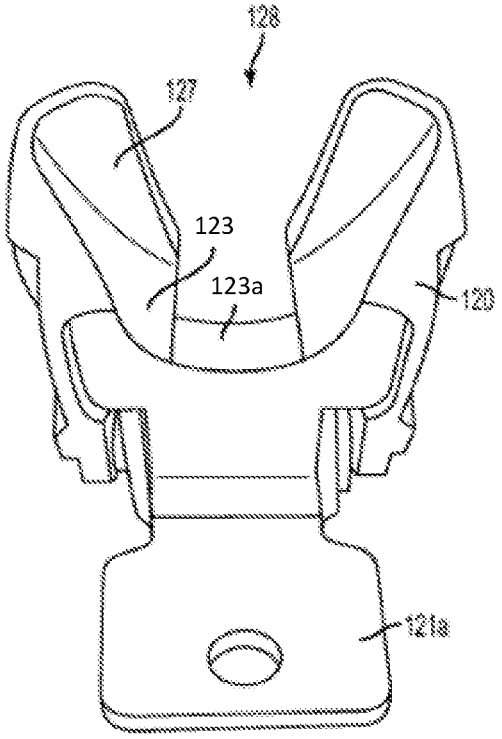

FIGS. 5 and 6 show an embodiment wherein the first pivotable surface 113 is a curved element 113*a* wherein the width W of the curved element forms the widest part of the clasp 111. As shown in FIGS. 1 and 11 the outer circumference of the hemispherical portion with a width W forms the widest part of the elongated portion 116. This arrangement allows the clasp 111 to pivot within the receiver 120 in both directions relative to a longitudinal axis L or a central axis of the first pivotable surface, as indicated FIG. 6. The clasp 111 may pivot a predetermined number of degrees in both of the directions that are transverse to the alignment of the attachment system and relative to a longitudinal axis L, as shown in FIG. 6.

An objective is to reduce binding of the buckle system while the boot moves through its range of motion. For example, 1-8 degrees of pivot, or float, or thereabouts, is suitable to achieve the objective.

The clasp 111 includes an elongated member 116 having a first end 118 and a second end 117. The first end 118 of the elongated member is free and may have a grip portion 114 that is ergonomically designed. An ergonomically contoured shape refers to a shape that may be contoured to minimize physical effort, minimize possible discomfort and hence maximize efficiency to open or close the attachment system. For example, the grip 114 may be a distinct part made of a soft rubber material that enhances gripping by a user and that is contoured upwards at the upper portion of the free end of the clasp thereby providing a portion for a user to grab and move away from the boot to unlock the attachment system. The soft rubber material and overall shape of the grip 114 do not interfere with the overall comfort and effectiveness of the attachment system.

Figure 3:
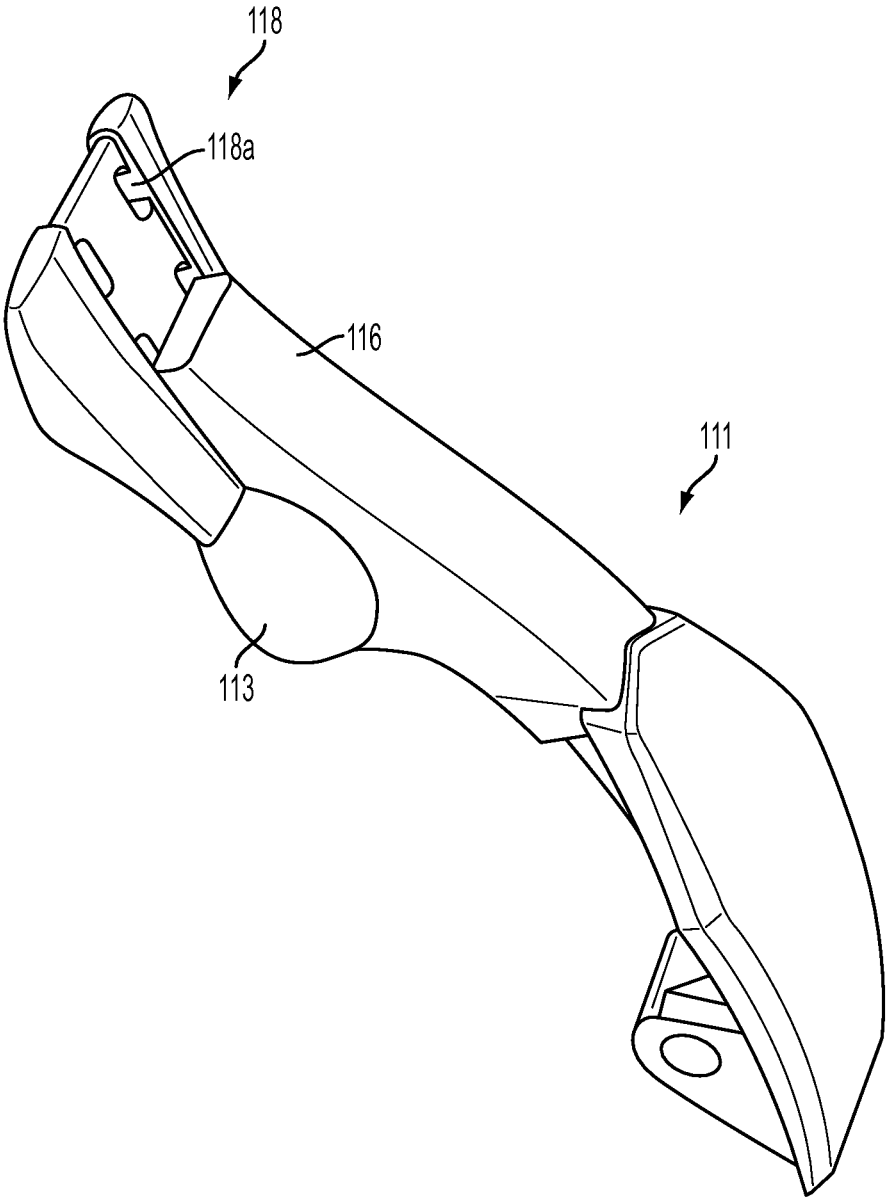
FIG. 3 shows a perspective top view of the clasp.
Figure 4:
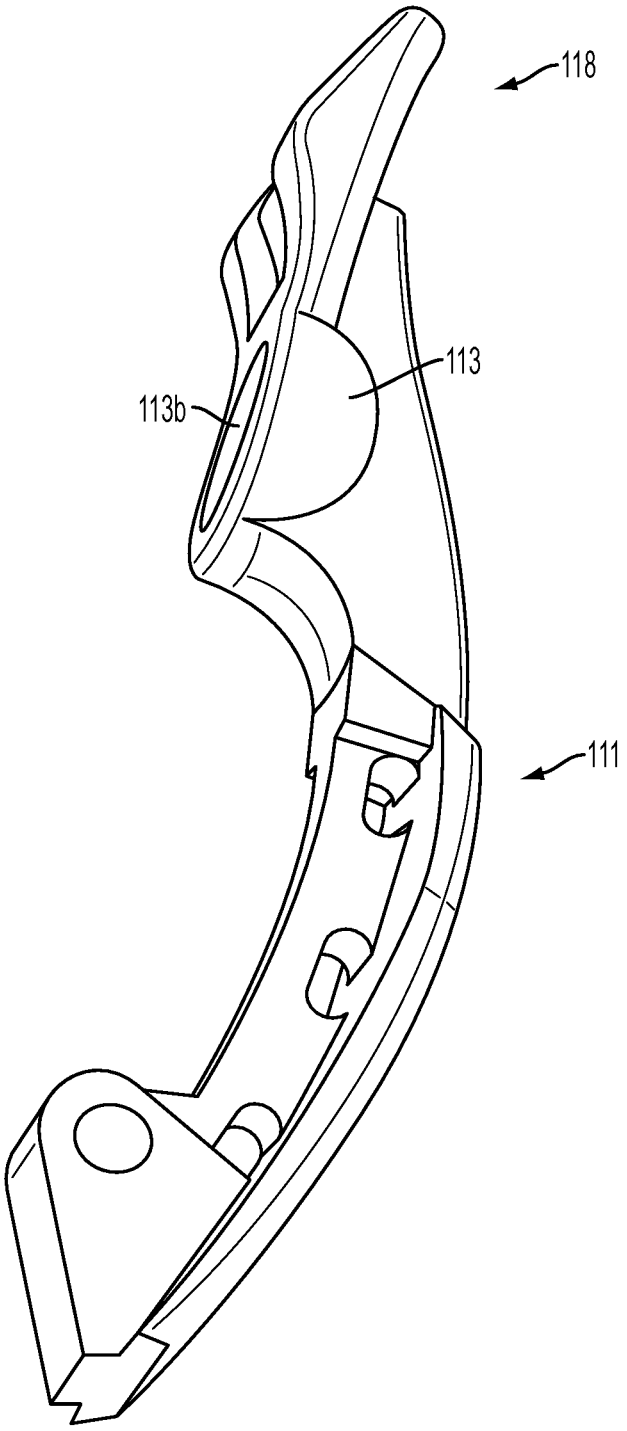
FIG. 4 shows a side view of the clasp.

FIGS. 1, 2, 7-12 show a grip portion 114 included at the end 118 of the clasp 111. The grip portion is optional. It may be made of a rubber material to provide for better handling for a user. It may be co-molded into the clasp or a separate piece connected to it. FIG. 3 shows how the free end 118 of the elongated portion 116 is adapted to accommodate the grip portion 114 by including openings 118*a* in a recess in the elongated portion that secure the grip portion in a snap fit arrangement. The grip area may also be monolithically formed and integrated with the rest of the clasp.

The second end 117 of the elongated portion 116 is adapted to be coupled to a strap 112, for example, as shown in FIGS. 1-4 via a wider upper portion and a snap fit system at a bottom portion of the clasp, or by co-molding or otherwise coupling the parts.

The elongated portion 116 of the clasp 111 includes a first pivotable surface 113, such as curved element wherein the curved sides form the widest portion of the elongated portion from a top view of the clasp.

In the embodiment shown in the figures, the pivotable surface 113 of the clasp 111 is a hemispherical portion with the curved side integrated with the elongated portion 116 and the base 113*c* of the hemispherical portion facing away from the elongated portion. Optionally, the curved element of the clasp 111 may be hollowed at the inner surface of the clasp, creating a depression or a recess 113*b* which houses the buckle base mounting screw when fastened.

In other embodiments, the first pivotable surface may be a sphere, ball-shaped, or spheroid element. Some embodiments may have pivotable surfaces including differently shaped elements that allow the clasp to move within the receiver, for example, one or more toothed portions, such as gear-like elements, that allow some pivoting motion of the cap within the receiver.

Figure 7:
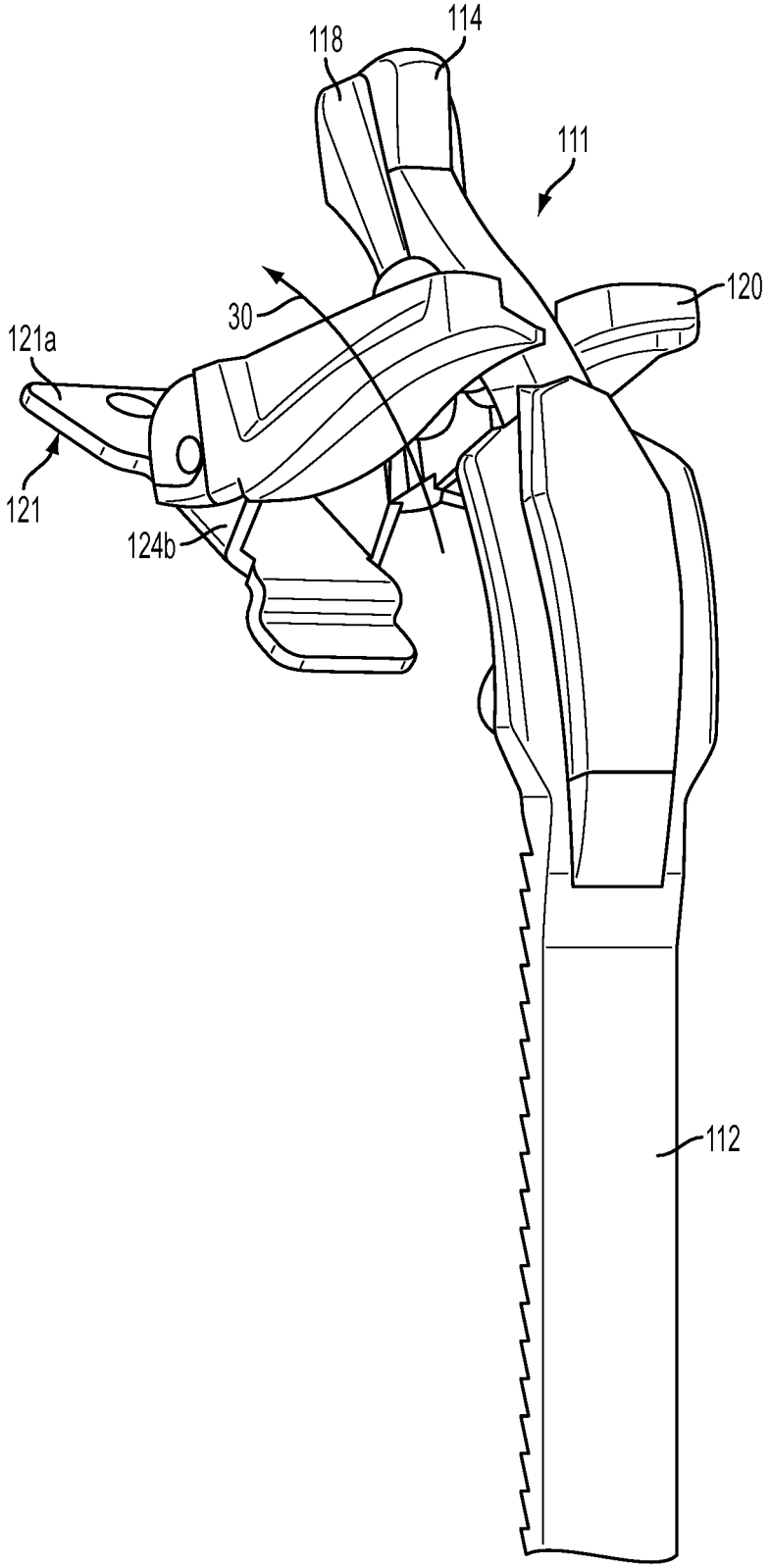
FIGS. 7-8 shows a perspective view of the clasp and strap as the clasp engages the receiver in an open position. The receiver is attached to an anchor.
Figure 8:
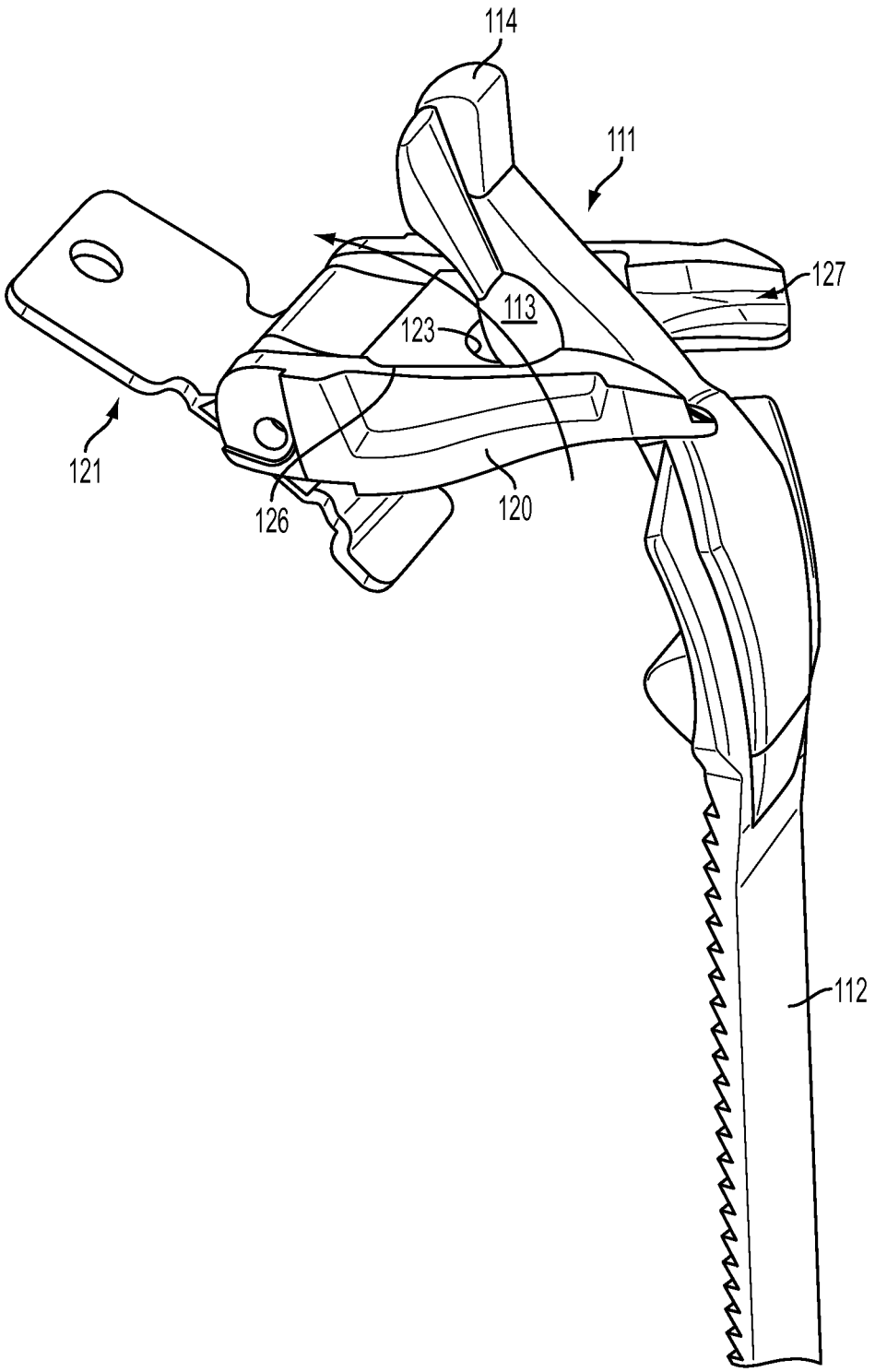
Figure 9:
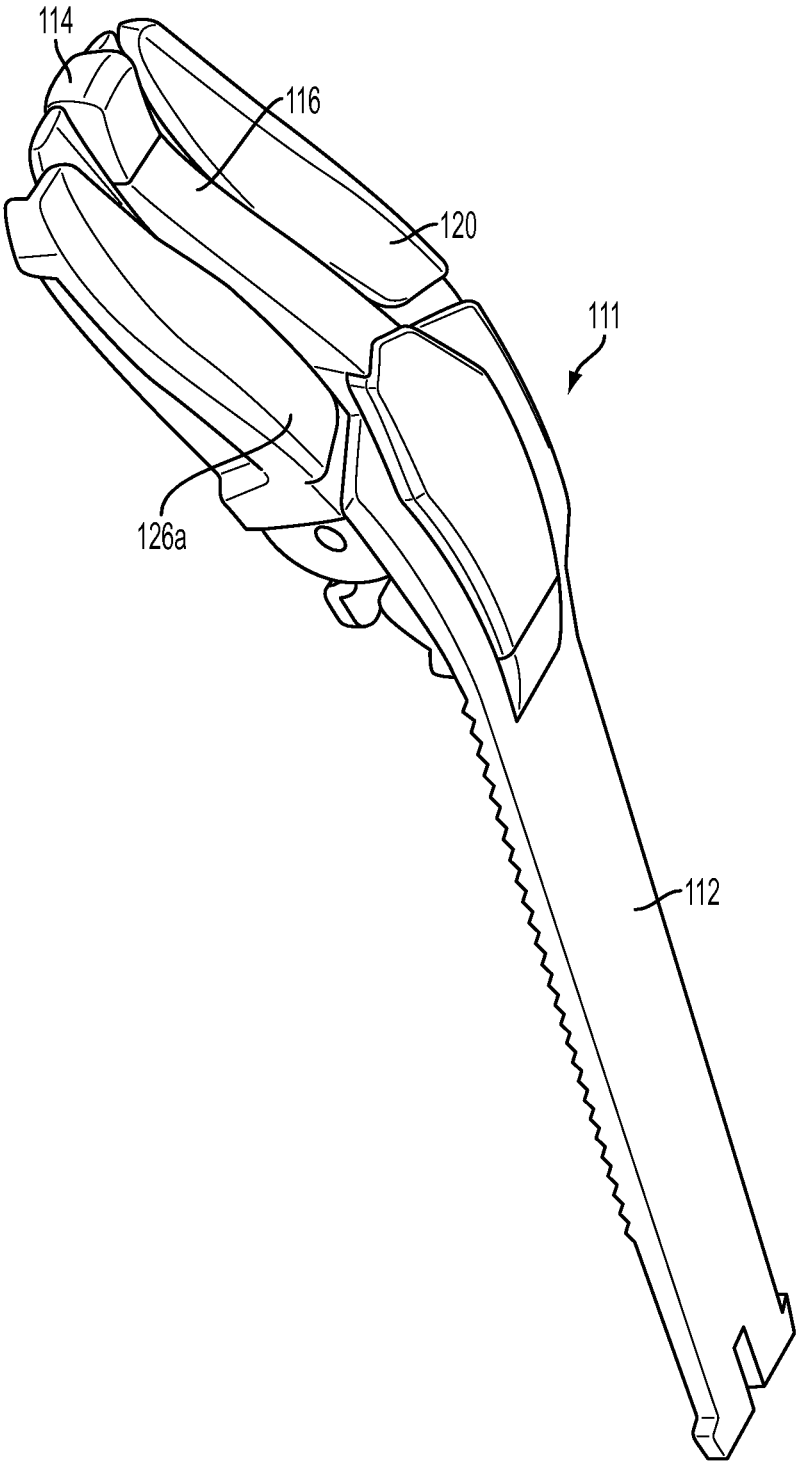
FIG. 9 shows a perspective view of the clasp and receiver in the closed position.

When the buckle assembly is engaged with the receiver, the attachment system is closed by pulling the clasp and receiver forward. In FIG. 7 the arrow 30 indicates the directions in which the clasp 111 and receiver 120 move upon closing. The receiver 120 and clasp 111 move in the longitudinal direction L of the attachment system thereby pulling the two portions of the boot upper towards each other. The receiver 120 rotates around a pivot axis 125 in a longitudinal direction of the receiver until an inner surface 126 of the receiver reaches the anchor 121 or another stop surface of the boot upper. As shown in FIGS. 5, 6, 9, 10, and 11, the elongated portion 116 is held by the receiver 120 and locked with the receiver on the anchor base 121*a*. The pivot axis 125 holds the receiver 120 tensioned to the anchor base.

In some embodiments, the pivot axis 125 may be formed by the anchor pin 124 (e.g., an elongated cylindrical pin) that cooperates with openings in the receiver. When moving the attachment system towards the closed position, the clasp 111 and the receiver 120 move forward and the pivotable surface 113 of the clasp 111 rotates in a socket 123*a* of the second pivotable surface 123 of the receiver 120 while the receiver 120 and the clasp 111 are being pulled forward.

Figure 19:
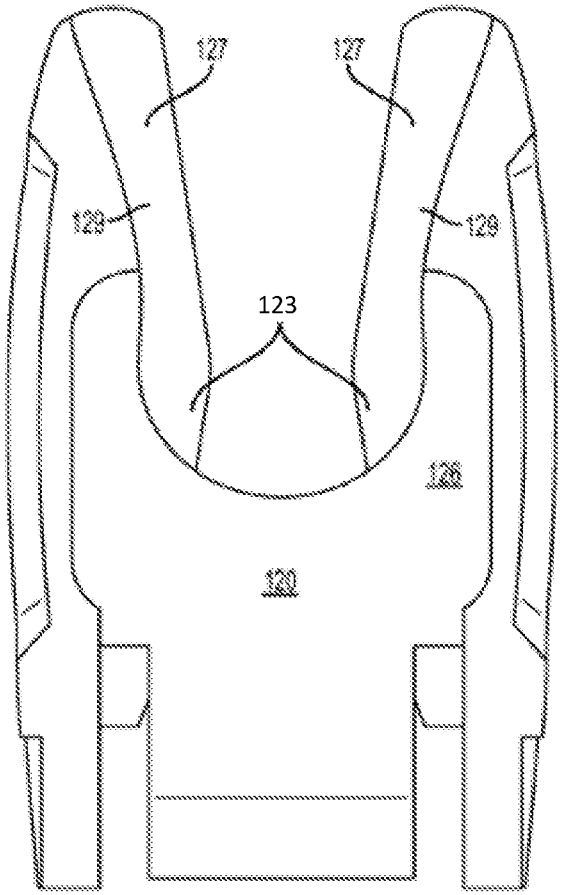
FIGS. 19-21 show additional views of the receiver.
Figure 20:
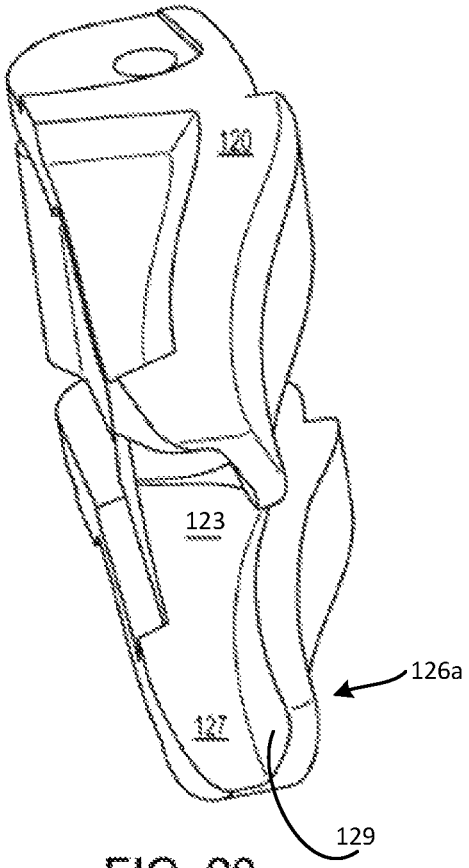
Figure 21:
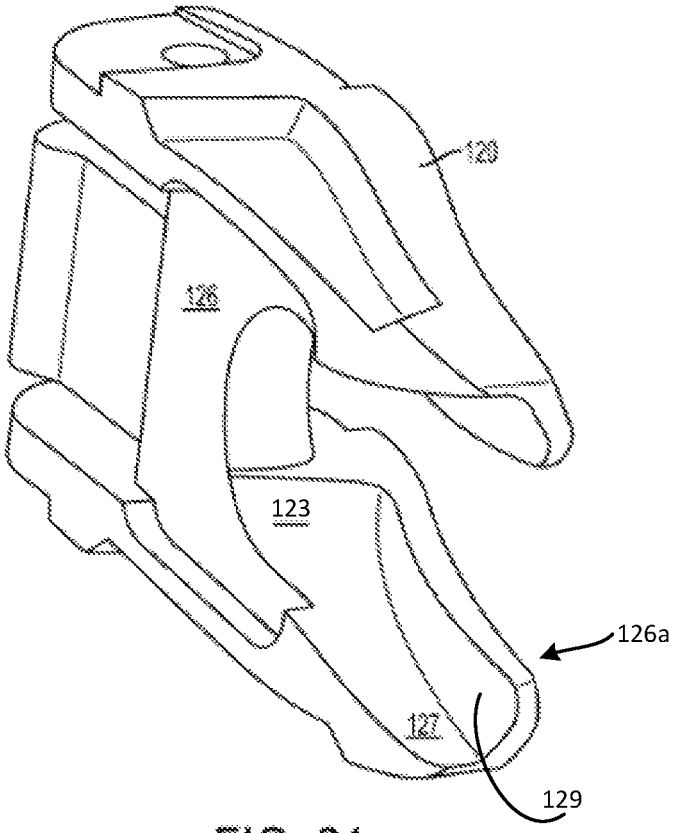
Figure 22:
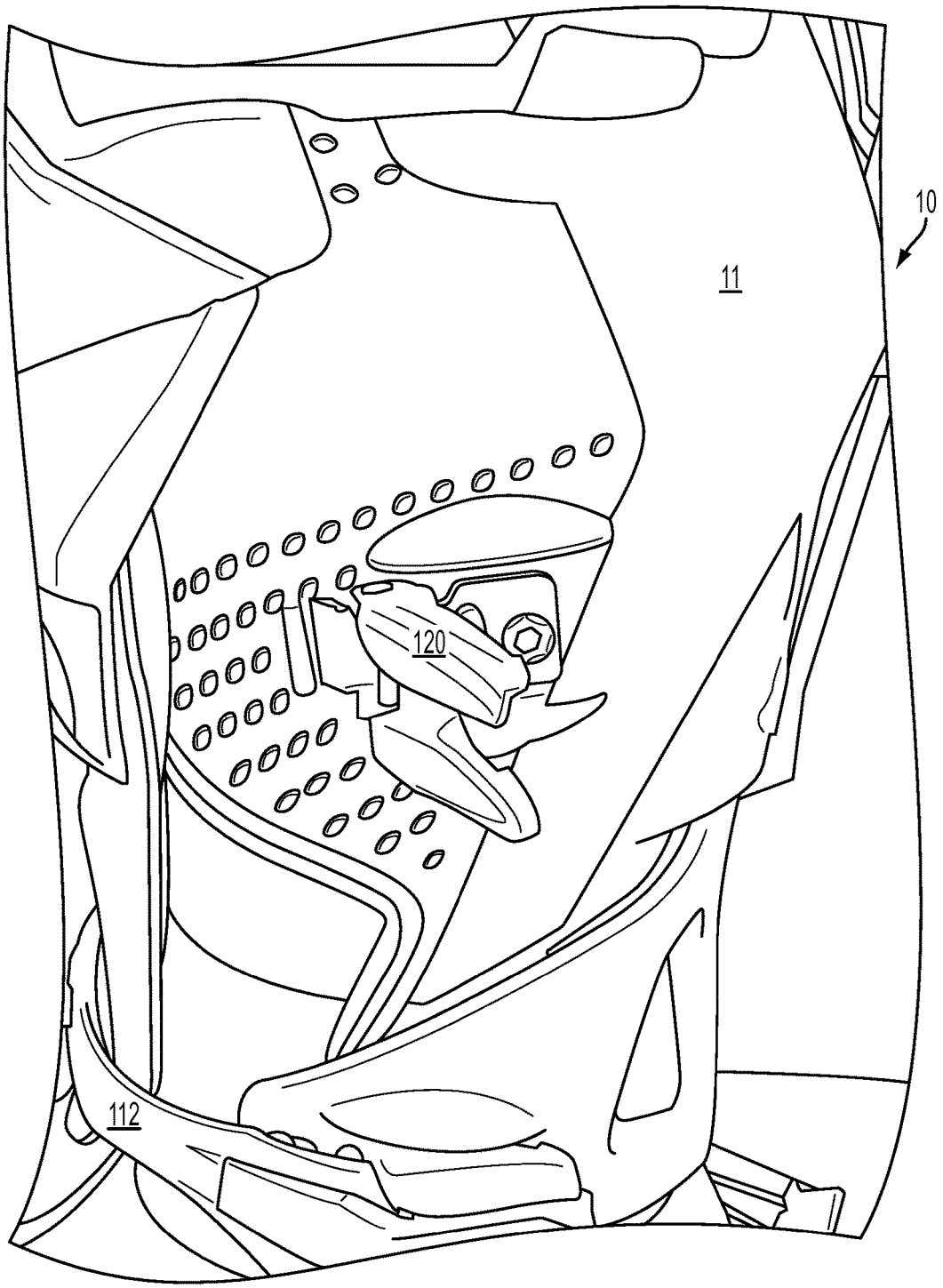
FIGS. 22-24 show an embodiment of the inventive buckle system assembled onto a boot.
Figure 23:
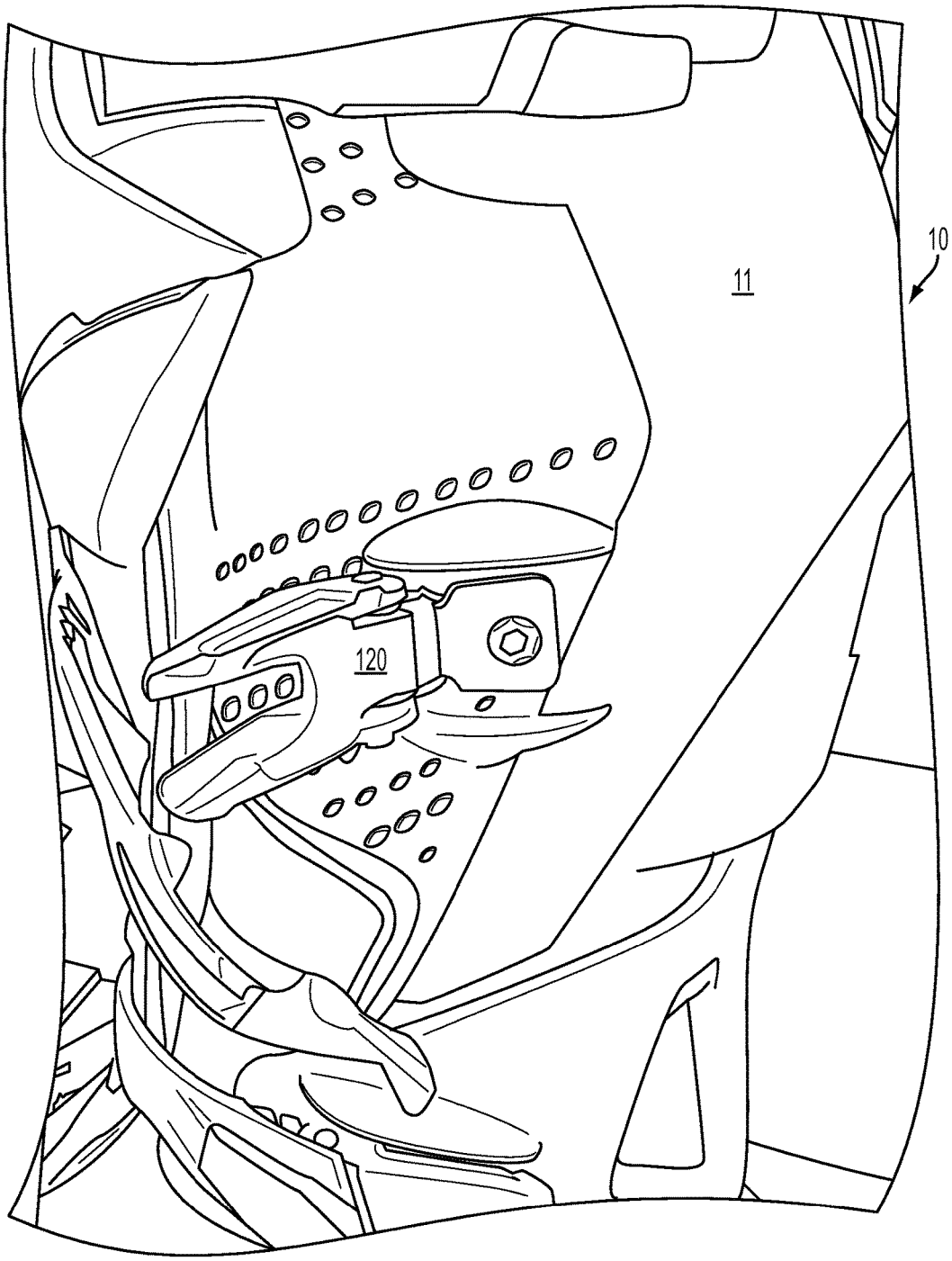
Figure 24:
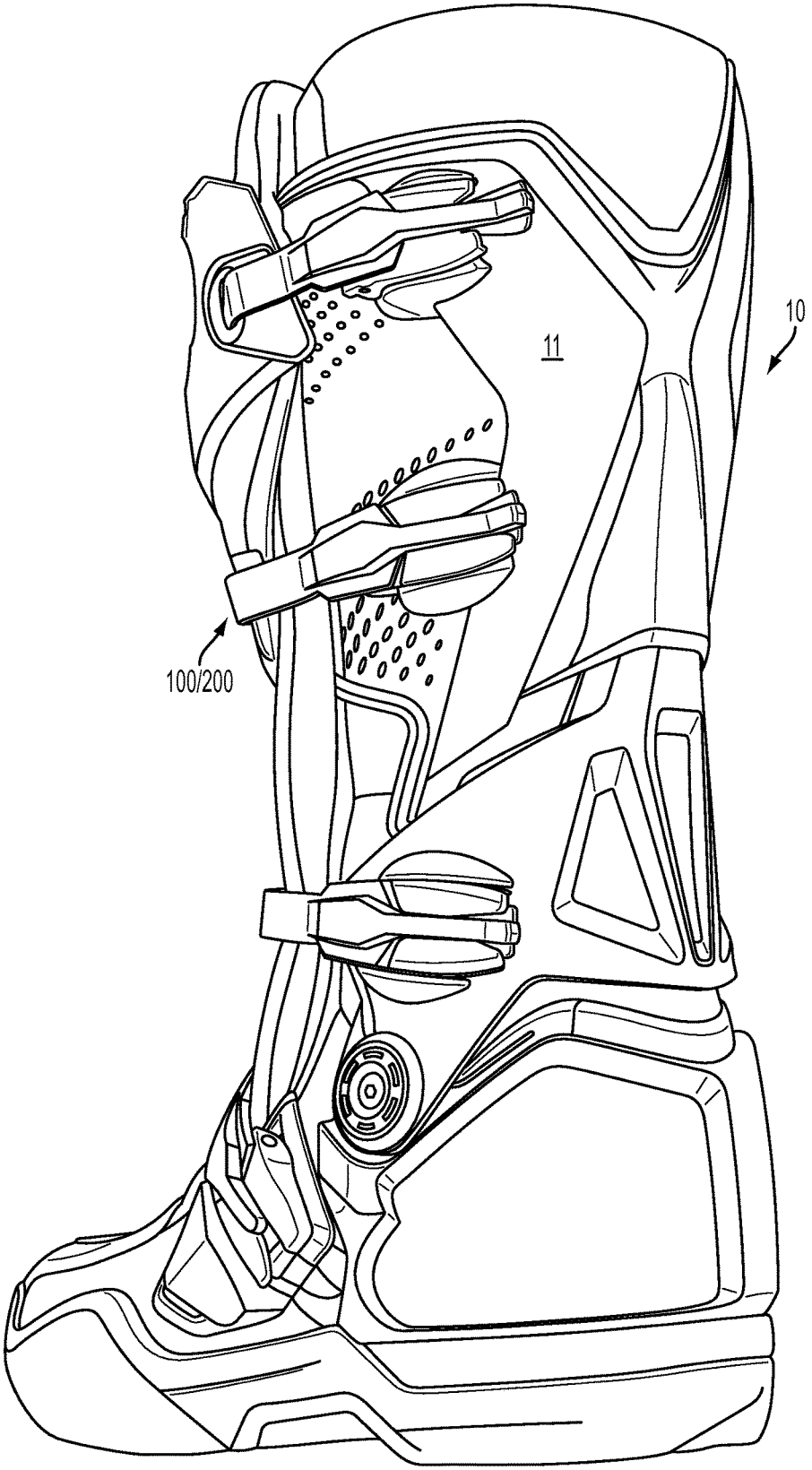

The receiver 120 may have a generally rectangular shape. An example of a receiver 120 coupled to an anchor 121 is shown in FIGS. 13-18. FIGS. 19-21 show an example of receiver by itself. One end of the receiver 120 has an elongated recess in the form of a U-shaped opening 128 adapted to receive and secure the buckle assembly. The other end of the receiver is adapted to attach to the footwear, for example via an anchor pin 124. The receiver 120 has an outer or upper surface 126*a* that faces away from the boot when the buckle is closed, and an inner surface 126 that faces the boot when the buckle is closed. The upper surface 126*a* of the receiver has a top view showing an opening 128 or slot with a wing-shaped design 129. The inner surface 126 of the receiver is shaped to form an opening, receding part, or indentation that is U-shaped and wherein the U-shaped opening angles outward from a center portion of the U-shaped opening towards the edge of the receiver. The second pivotable surface 123 of the U-shaped opening 128 further has a portion that is adapted to house the curved element 113*a* of the elongated portion 116, for example the socket 123*a* at the bottom of the U-shape. As shown in FIG. 21, a socket 123*a* may be formed by a curved ridge along the legs of the U-shape. The upper surface of the ridge may curve towards the upper surface of the receiver and curve slightly towards the inner surface of the receiver along the legs of the U-shape. When the buckle assembly is positioned in the receiver and the attachment system is in the closed position, the curved element of the clasp 113*a* is held in the socket 123*a* of the receiver 120. The U-shaped portion 128 allows pivoting of the clasp 111 within the receiver 120. The side extensions at the upper of the U-shape align the clasp 111 within the receiver 120. The graduated slope of the side extensions of the slot from the socket 123*a* to the receiver's end allows the clasp 111 to slide out easily of the receiver 120 when the lever is released.

FIGS. 20 and 21 show a receiver 120 having an outer surface 126*a* that extends over the U-shaped opening. As shown in FIGS. 19-21, the outer surface 126*a* extends along the legs of the U-shaped opening 128 to form a wing-shaped cover 129 of the opening. Each side portion of the wing-shaped cover 129 extends over the opening 128 at obtuse angles to hold the elongated element 116. The tip of the angled portion corresponds to the center of the curved element. The side extensions along the recess 127 hold the curved element within the receiver upon release. The complementary shape of the receiver 120 and clasp 111 allows fastening of the buckle in the longitudinal direction L of the buckle. The gradually outward angling of the U-shaped recess allows for easy removal of the clasp from the receiver.

Figure 10:
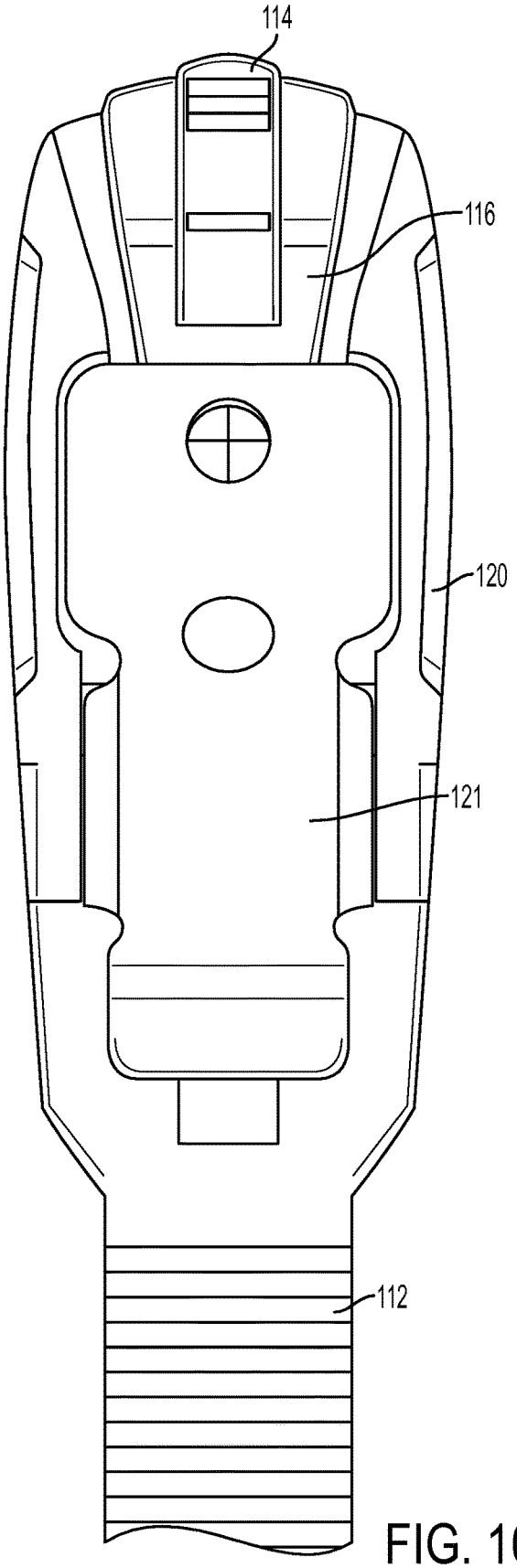
FIG. 10 shows a bottom view of the base, receiver, and clasp in the closed position.

The elongated portion 116 may further have a curved extending part positioned between the pivotal surface and free end of the elongated portion. This extending part may cooperate with the receiver 120 and/or anchor base 121*a* to tension the clasp 111. For example, as shown in FIGS. 6, 10, and 11, the extending part may interact with the wing shaped structure of the receiver 120 to hold the clasp 111 at the free end in the longitudinal direction while allowing transverse movement of the clasp at the other end. The recessed area of the clasp 111 includes left and right vertical walls that act as stops, limiting the left and right float of the clasp in the receiver 120. As noted earlier, an about 8 degree float in each direction is an example of suitable float.

The attachment system further may include an anchor 121 for coupling the receiver 120 to a boot portion. The anchor 121 has a base 121*a* and two protruding wings extending upward from the base. In other embodiments, the base may be integral with the upper portion. The protruding wings are transversely connected by the anchor pin 124 that couples the receiver 120 to the base 121. The receiver rotates around the wings 124*a* and the anchor 124. The anchor pin 124 may be an elongated cylindrical pin positioned between the wings of the base and extending through the base wings to extend through openings in the receiver. To hold the pivot pin 124 in place the pin ends on both sides with enlarged heads. The length of the pin 124 is generally fitted to the width of the base and receiver. The receiver 120 is coupled to the anchor pin 124 so that the receiver 120 is rotatable around the pivot axis 125. Upon closing of the attachment system, the receiver rotates in the anchor base and the clasp extends forward of the receiver thereby tensioning the clasp and buckle strap.

The anchor 121 may be glued or bonded onto a portion of the upper, or the anchor may be mechanically fixed to the upper via bolts, rivets, snaps, screws, stitching, staples and the like. FIGS. 13-18 show an embodiment wherein the anchor is secured by a screw 121*b* extending through an aperture 121*b*' in the anchor 121. In certain embodiments, the anchor can be fixed to the boot. In other embodiments, the anchor 121 may rotate around the screw or other fastener to facilitate adjustment and fitting of the attachment system.

An item of footwear may be made by providing a sole unit with an upper and an attachment system such as described above. The sole unit may be composed of conventional materials providing suitable stiffness and protection, including plastics, rubbers, natural or synthetic compressed leather, or combinations thereof, including laminated sole units having layers of different materials. Optionally, a metal plate may be sandwiched within layers of the sole unit, a layer of compressible sponge or foam material can be added within the sole, and/or a metal toe plate may be mounted on the front toe area of the sole. The upper is attached to the sole unit and extends upwardly therefrom and wraps around at least a portion of the lower leg of a wear. It has an opening for receiving a wearer's foot when the boot is secured to a wearer's leg. The boot typically is sized to receive the wearer's foot, ankle, and at least a portion of the wearer's lower leg. The upper may include several different components that serve functional or protective needs of a wearer, for example an impact shield, an attachment system, optional design indicia, a toe/instep control area for contacting the motorcycle, a foot/leg encasement, a protective heel plate, a thermal laminate, and/or a top gasket. Any suitable material that provides the minimum physical characteristics may be used to construct each part of the upper.

The buckle assembly and receiver may be made from any suitable, rigid material including, but not limited to rigid thermoplastics, such as PVC (polyvinyl chloride) or PS (polystyrene); metals or alloys, such as stainless steel, brass, aluminum, tungsten, or nickel; and composite materials, such as molded carbon fiber or fiberglass composites. Additionally, combinations of these materials may be used.

The attachment system described herein may be assembled through a variety of manufacturing processes. For example, one or more parts of the attachment system may be manufactured using an injection molding process employing a three-dimensional mold.

Generally speaking, the manufacturing method may include the following steps (which may be accomplished in almost any desired order):

1. providing a sole unit;
2. providing an upper having a split defining a first upper portion and a second upper portion;
3. providing a buckle assembly having a clasp adapted to be coupled to a first portion of the footwear upper, the clasp comprising an elongated portion having a first pivotable surface;
4. providing a receiver adapted to be coupled to a second portion of the footwear upper, the receiver having an elongated recess adapted to slideably receive the elongated portion, the receiver having a second pivotable surface that is sufficiently complementary shaped to the first surface so that the surfaces pivotably engage each other in a transverse direction of the attachment system when the buckle assembly is locked in the receiver;
5. coupling the buckle assembly to the first portion of the upper;
6. coupling the receiver to the second portion of the upper; and
7. attaching the upper to the sole unit.

The term "providing" is a non-limiting term meant to encompass any acquisition of a part, such as manufacturing the part or obtaining the part from third-party vendor or supplier.

Alternative Embodiment

Figure 25:
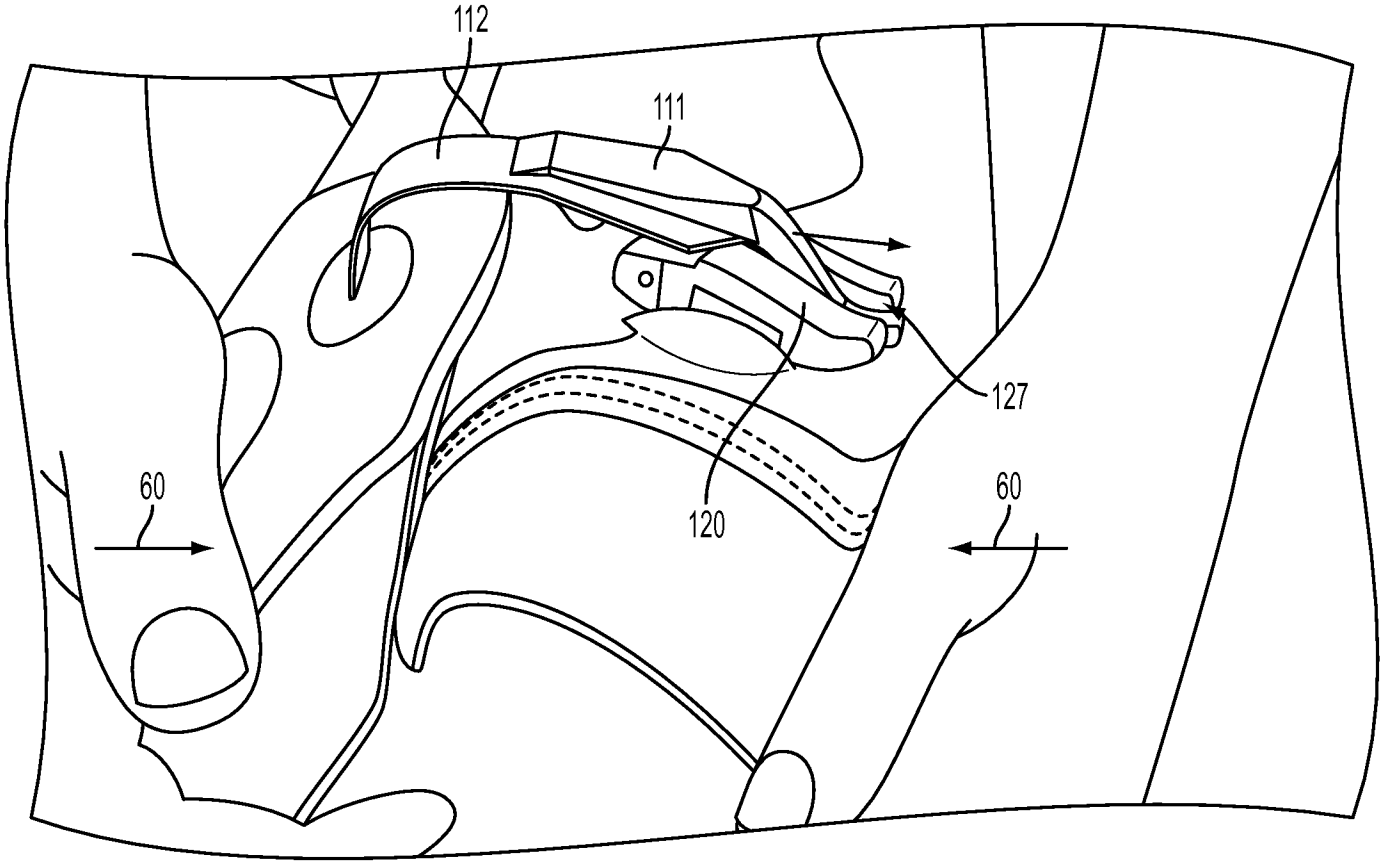
FIG. 25 shows a closure of the attachment system shown in FIGS. 22-24 when the upper of the boot is under a compressive load.
Figure 26:
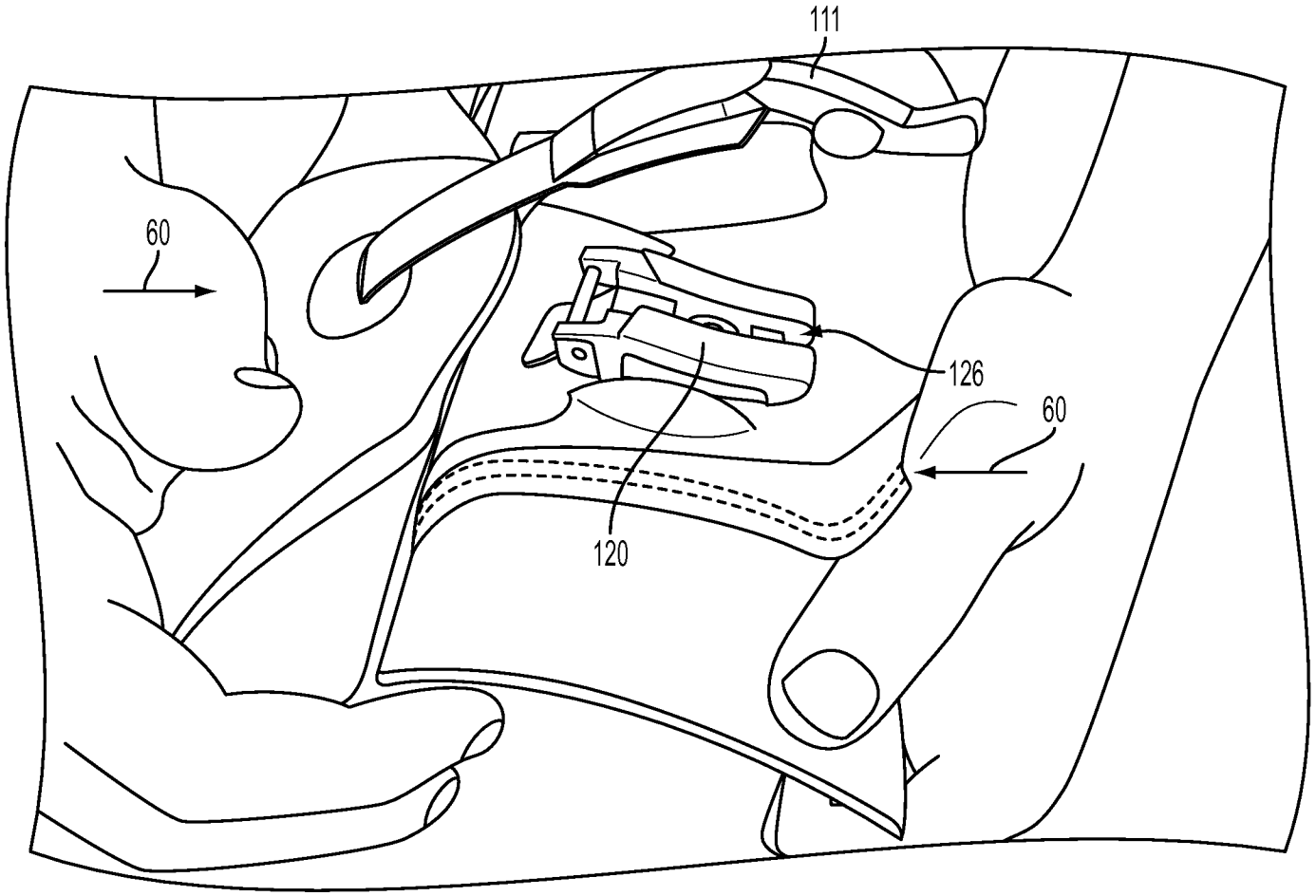
FIG. 26 shows a disengagement of the buckle assembly from the receiver shown in FIGS. 22-24 resulting from a compressive load applied to the upper.

As described above, a buckle assembly having a clasp and a receiver can constitute a closure for an upper of a boot. In some instances, the upper of the boot can urge together in compression (indicated by arrows 60 in FIGS. 25 and 26) and slacken a tension load, or compress, the clasp-and-receiver engagement, effectively loosening the clasp-and-receiver engagement, e.g., as shown in FIG. 25. Under sufficient compression, the clasp 111 and the receiver 120 shown in FIG. 25 can disengage from each other and loosen or release the upper relative to a wearer's leg, as shown in FIG. 26. Such an unintended or an unwanted disengagement of the closure can inconvenience a user by requiring an interruption of, for example, a motocross activity, to permit the user to reclose the clasp 111 and receiver 120.

Figure 32:
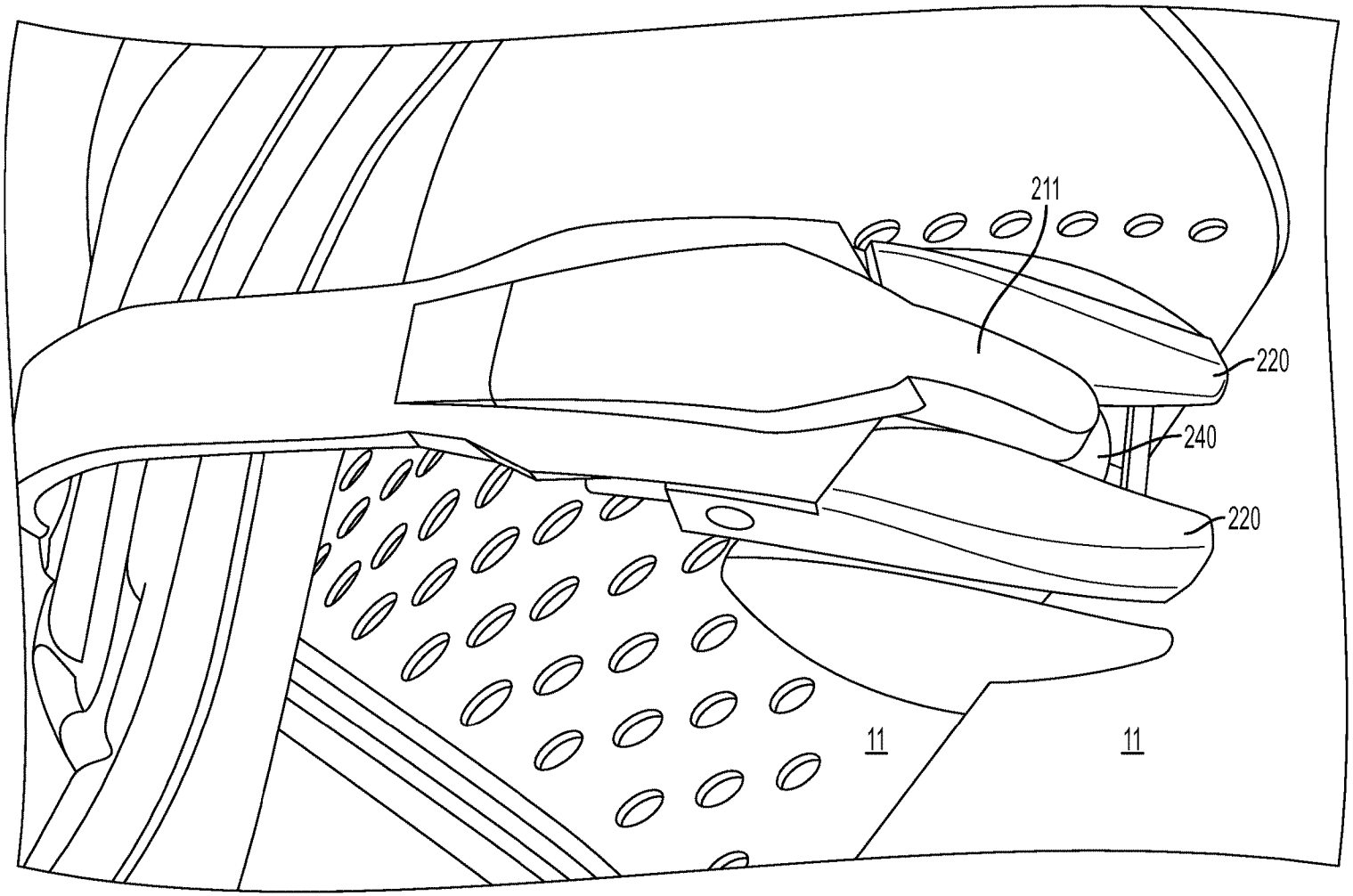
FIG. 32 shows another view of the closure shown in FIG. 31.
Figure 33:
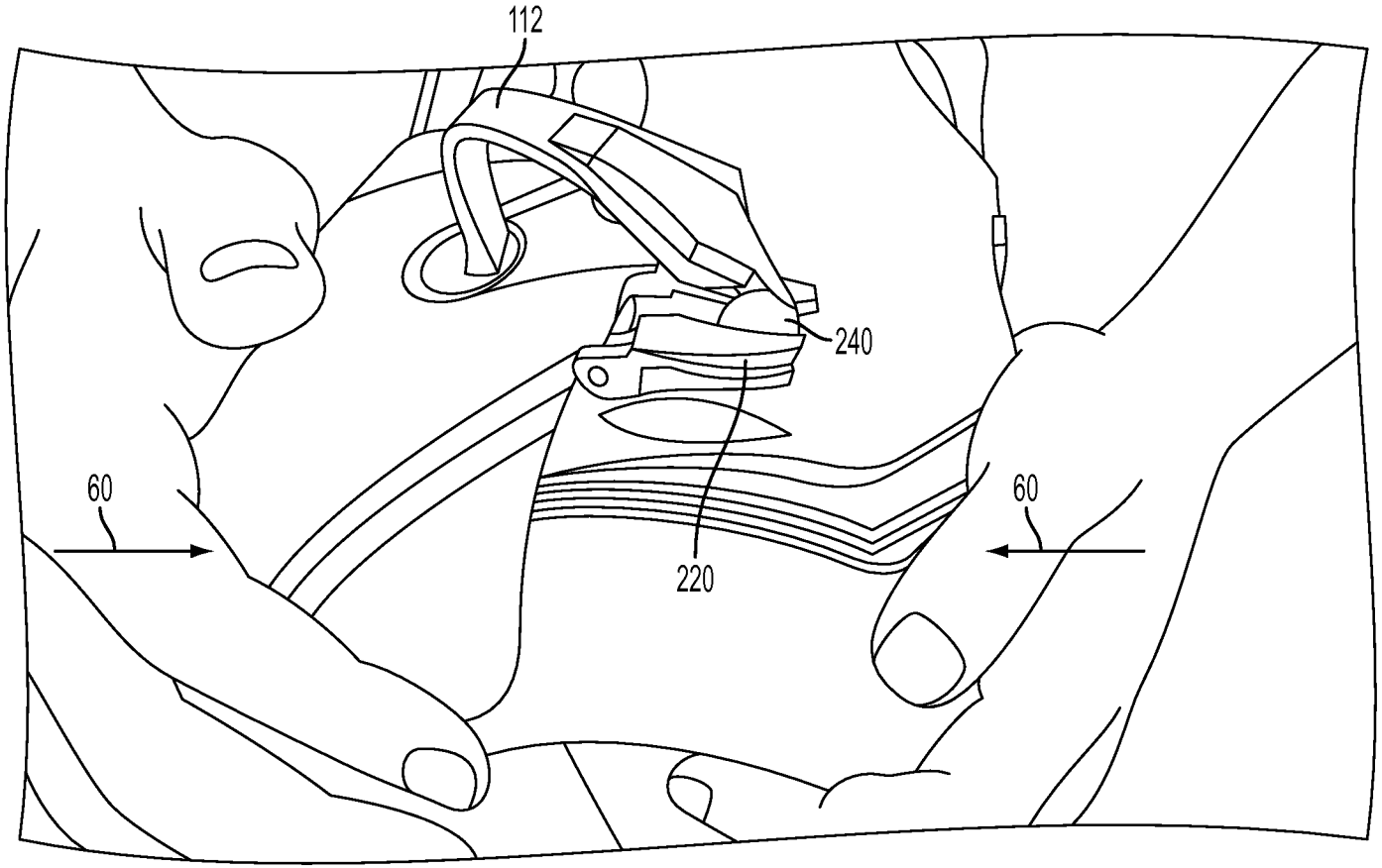
FIG. 33 shows the alternative embodiment shown in FIGS. 27 through 29 when the upper of the boot is under a compressive load. A mating engagement between the clasp and the anchor inhibits disengagement of the buckle assembly from the receiver.

Some alternative embodiments of innovative uppers are configured to inhibit unintended disengagements between the clasp and the receiver. For example, the attachment system 200 shown in FIGS. 27 through 33 secures the clasp 211 to the upper 11 when the closure is closed, while still permitting relative ergonomic movement of a wearer's leg within the upper as described above in connection with the embodiments shown in FIGS. 1-24. The closure can also accommodate slackening in tension, and even compression, between the receiver 220 and the clasp 211 without suffering an unintended disengagement between the clasp and the receiver. For example, as shown in FIG. 33, the strap 112 has buckled in compression and a portion 240 of the clasp 211 remains matingly engaged with the anchor.

Figure 29:
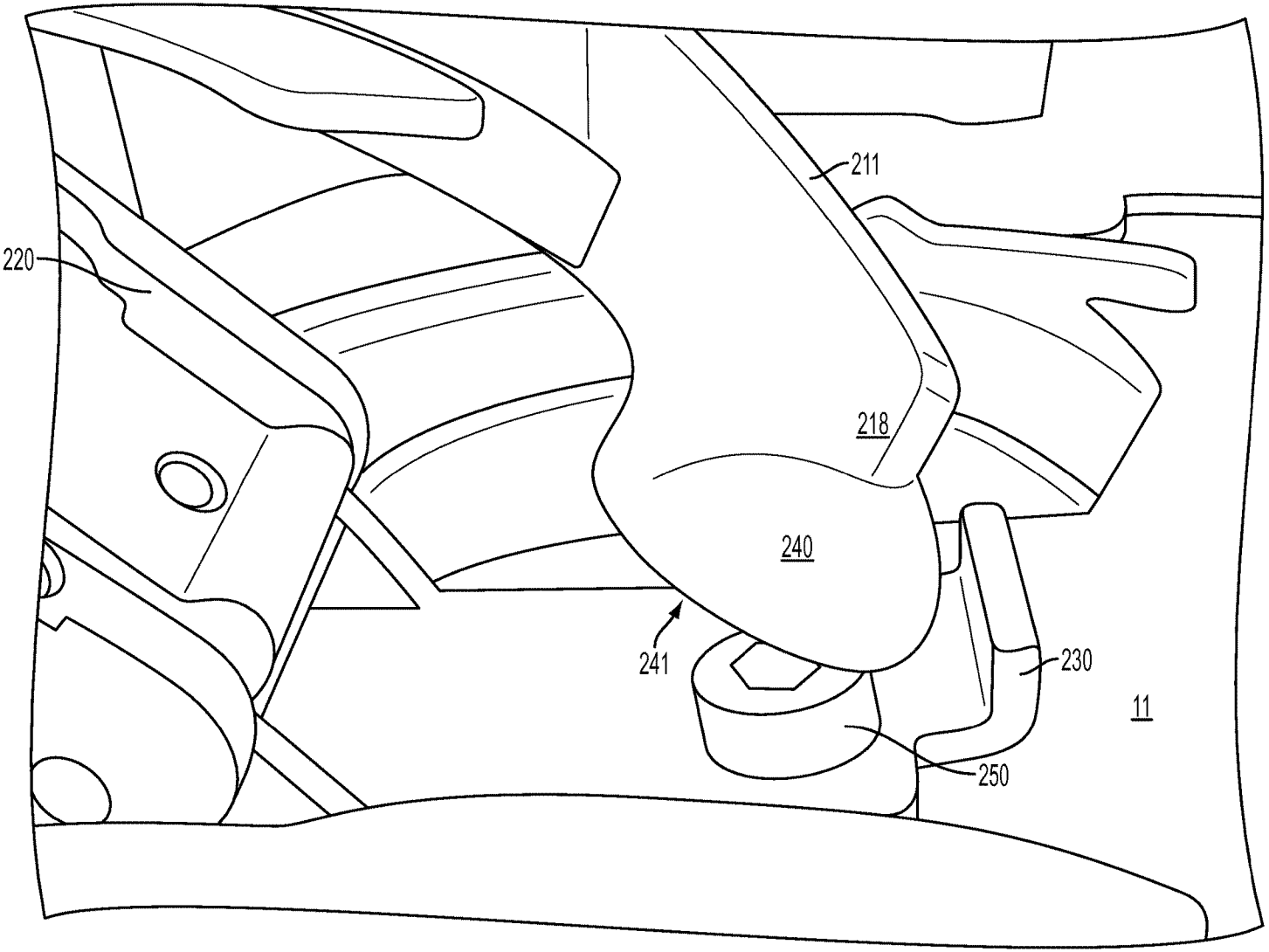
FIG. 29 shows a distal portion of the clasp of the alternative embodiment shown in FIGS. 27 and 28 positioned in the recess of the receiver.
Figure 30:
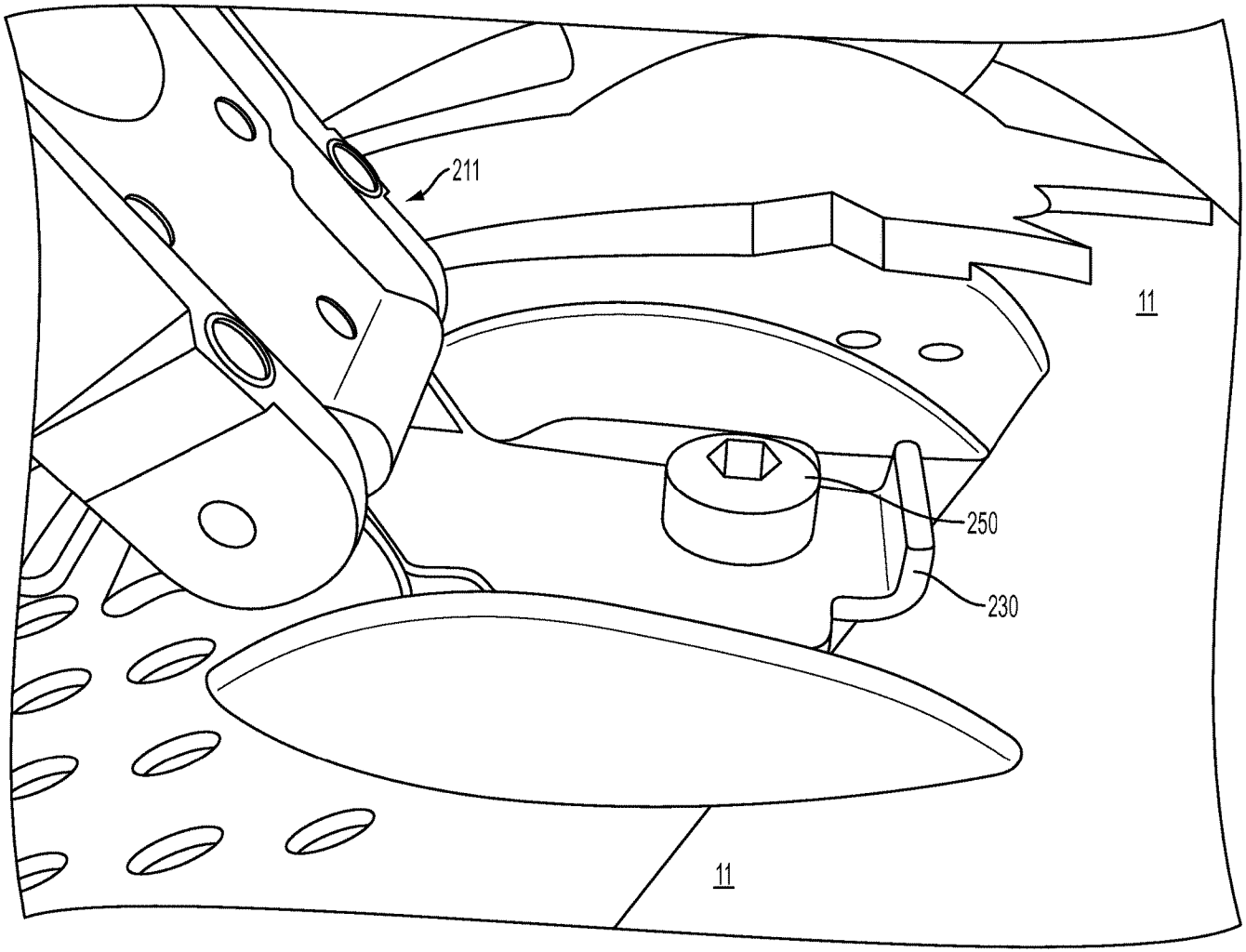
FIG. 30 shows the anchor and the clasp mounted to an upper of a boot.

As shown in FIG. 29, the upper 11 can have a first engagement portion 250 and the clasp 211 can have a second engagement portion 240. In some embodiments, the first engagement portion 250 and the second engagement portion 240 are correspondingly configured so as to be matingly engageable with each other to permit a user to matingly engage the first engagement portion and the second engagement portion with each other and to selectively disengage the first engagement portion and the second engagement portion from each other.

Figure 31:
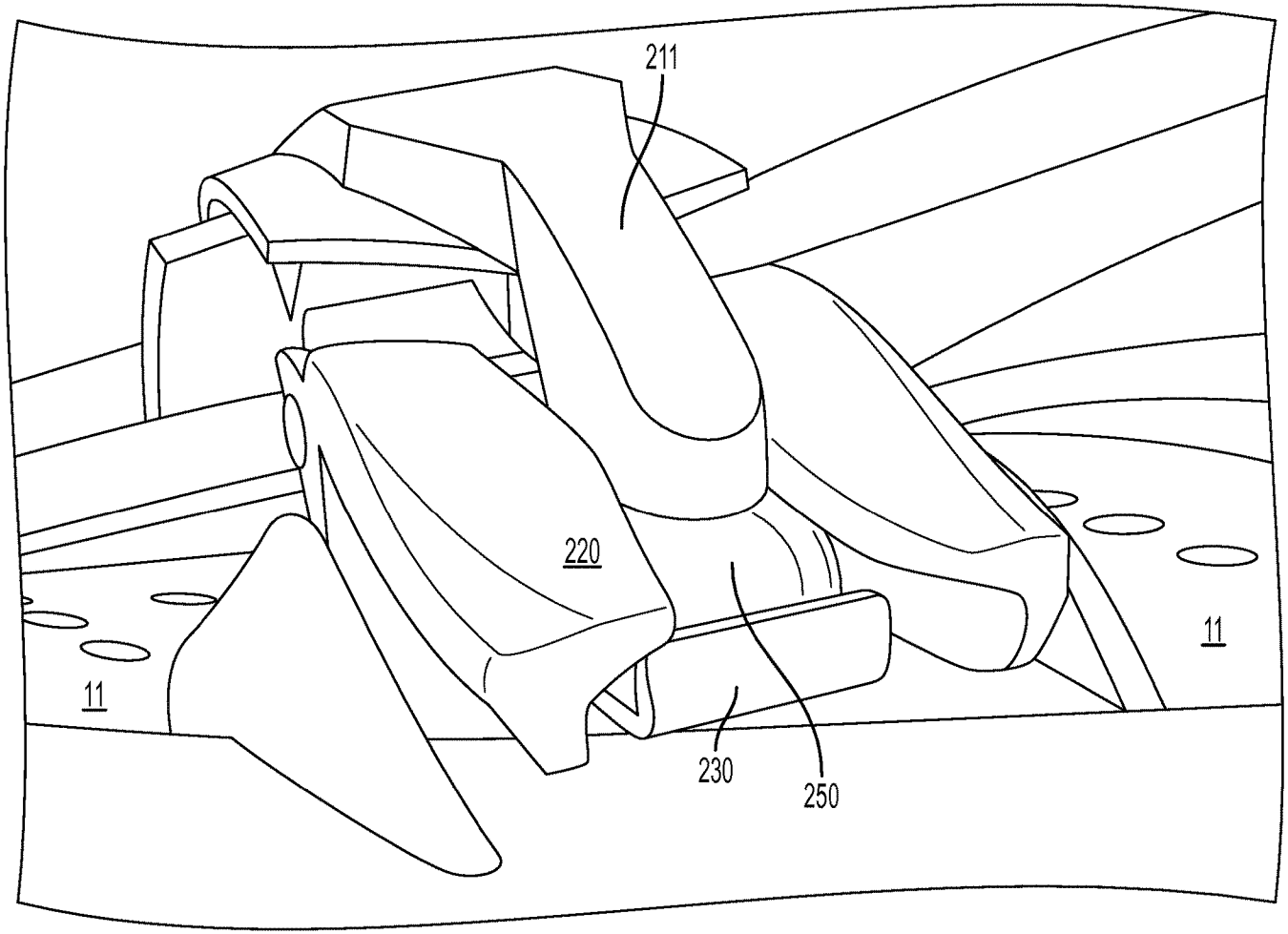
FIG. 31 shows a closure of the alternative attachment system shown in FIGS. 27-30.

For example, the first engagement portion 250 and the second engagement portion 240 can be removably coupleable with each other so as to limit or altogether eliminate a relative motion between the clasp 211 and the upper 11. The relative motion can include a translation motion and/or a rotation motion relative to one or more orthogonal axes. Such a disengageable, mating engagement is shown in FIGS. 31 and 33.

In some instances, the first engagement portion 250 can be fixedly attached to the upper 11. For example, a component fixedly attached to the upper 11 can define the first engagement portion. As but one example, an attachment screw similar to the one shown in FIG. 14 can define the first engagement portion 250, as shown in FIG. 29. In particular, in FIGS. 29 and 30, a head of a screw defines the first engagement portion and extends outwardly of the upper 11.

In other embodiments, the first engagement portion 250 can constitute a unitary construction with the upper 11 of the boot 10. For example, the upper 11 of the boot 10 can include a molded portion and the molded portion can define the first engagement portion 250.

As noted above and shown in FIG. 29, the clasp 211 can have a second engagement feature 240 having a configuration complementary to the configuration of the first engagement portion 250. In some instances, the second engagement portion 240 can be affixed to the clasp 211. As shown in FIG. 29, a component affixed to the clasp 211 can define the second engagement portion. In other embodiments, the second engagement portion 240 can constitute a unitary construction with the clasp. For example, the clasp 211 can include a molded portion and the molded portion can define the second engagement portion.

In FIG. 29, a socket member 241 extending from a free end portion 218 of the clasp 211 is configured to matingly receive the head of the attachment screw forming the engagement position 250. A relative motion between the free end portion 218 of the clasp 211 and the boot upper 11 is inhibited when the head of the screw is matingly received in the socket member 241, as shown in FIGS. 31 and 32.

In FIGS. 27 through 30, the screw head is configured as a so-called "allen" head. An allen head is typically generally cylindrically shaped and defines a hexagonal recess from a distal (relative to the upper) end of the head. The socket member 241 can define a recessed region configured to matingly overlie an outer portion of the head of the attachment screw. An upwardly extending lug (not shown) extending upwardly from a floor of the recess of the socket member 241 can be matingly received by the recess defined by the head of the attachment screw.

Other selectively matable engagement configurations are possible, as will be appreciated by those of ordinary skill in the art following a review of this disclosure.

Figure 27:
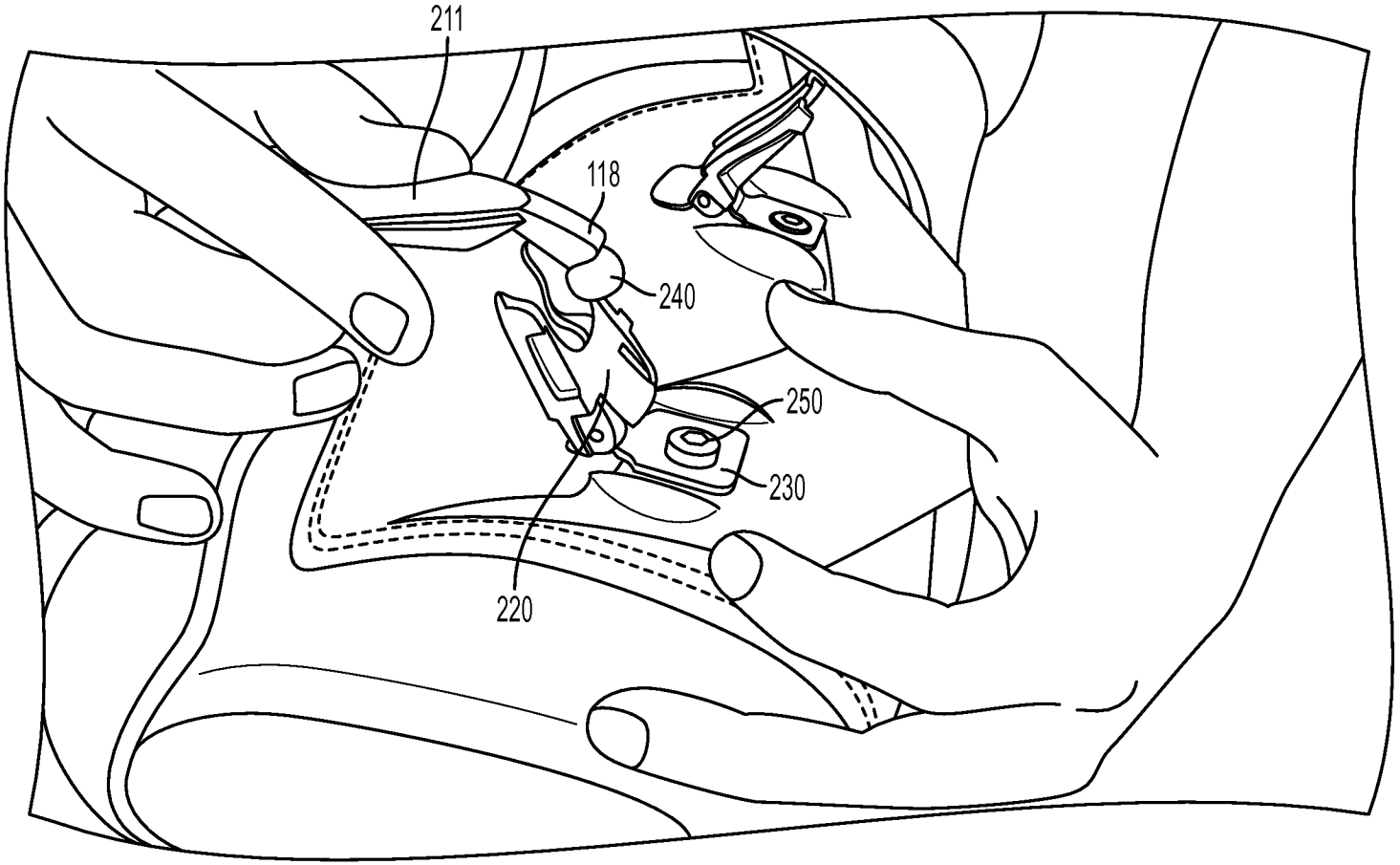
FIG. 27 shows an alternative embodiment of the attachment system.
Figure 28:
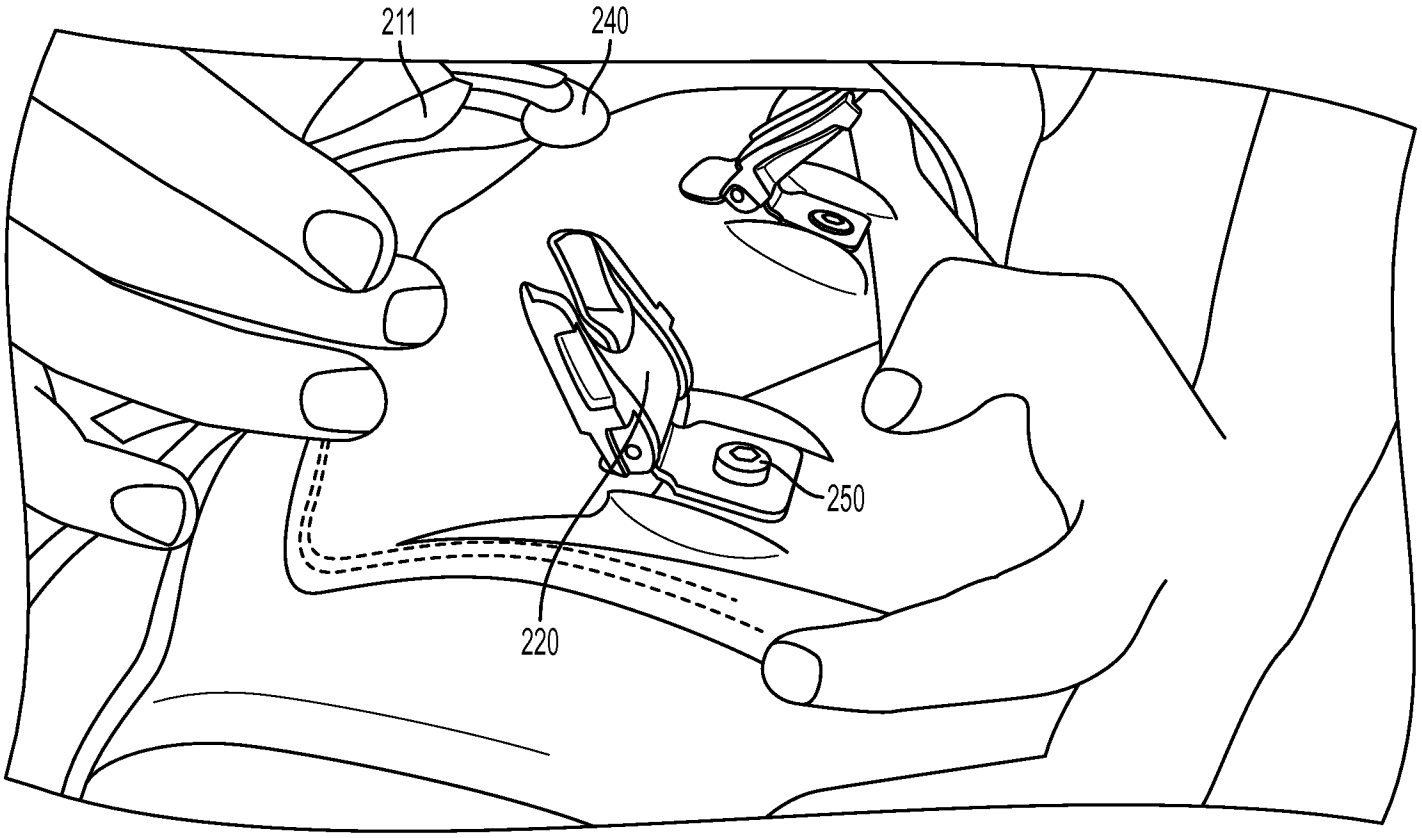
FIG. 28 shows another view of the alternative embodiment shown in FIG. 27.

A pivotable coupling, such as a ball-and-socket coupling, can couple the socket member 241 to the free end portion 218 of the clasp 211, as shown in FIG. 27. More particularly, the socket member can have a proximally extending lug (not shown) with a proximally positioned ball having a generally larger diameter than a diameter of the lug. The proximally positioned ball can be received in a corresponding socket (not shown) defined by the free end portion of the clasp. Such a pivotable coupling between the socket member 241 and the clasp 211 can permit the socket member 241 to pivot through a selected solid angle relative to the free end portion 218 of the clasp 211, providing a measure of variation in fit provided by the closure while simultaneously inhibiting inadvertent or otherwise undesirable disengagement of the closure.

The alternative attachment system embodiments just described can be easily released by a wearer, as through a one-handed manipulation of the clasp. For example, to release the closure, a wearer can urge a distal end of the receiver 220 in a generally perpendicular direction relative to the upper 11. Such a motion can tend to lift the clasp 211 away from the upper 11, together with the respective engagement portion 240 corresponding to the clasp. As the engagement portion 240 corresponding to the clasp 211 urges away from the engagement portion 250 associated with the upper 11, the first engagement portion and the second engagement portion can disengage from each other, selectively releasing the mating engagement between the first and the second engagement portions. Accordingly, the alternative attachment system embodiments just described provide an easy-to-release attachment system for footwear.

The drawings illustrate specific embodiments, but other embodiments may be formed and structural and logical changes may be made without departing from the intended scope of this disclosure.

Directions and references (e.g., up, down, top, bottom, left, right, rearward, forward, etc.) may be used to facilitate discussion of the drawings but are not intended to be limiting. For example, certain terms may be used such as "up," "down,", "upper," "lower," "horizontal," "vertical," "left," "right," and the like. Such terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" surface can become a "lower" surface simply by turning the object over. Nevertheless, it is still the same surface and the object remains the same. As used herein, "and/or" means "and" or "or", as well as "and" and "or."

All patent and non-patent literature cited herein is hereby incorporated by references in its entirety for all purposes. Incorporating the principles disclosed herein, it is possible to provide a wide variety of systems configured to render an electrosurgical handpiece inoperable at or near an end of the handpiece's safe useful life, in addition to the systems described above.

The technologies from any example can be combined with the technologies described in any one or more of the other examples. Accordingly, this detailed description shall not be construed in a limiting sense, and following a review of this disclosure, those of ordinary skill in the art will appreciate the wide variety of attachment systems that can be devised using the various concepts described herein. Moreover, those of ordinary skill in the art will appreciate that the exemplary embodiments disclosed herein can be adapted to various configurations without departing from the disclosed principles. Thus, in view of the many possible embodiments to which the disclosed principles can be applied, it should be recognized that the above-described embodiments are only examples and should not be taken as limiting in scope. Therefore, we claim all that comes within the scope and spirit of the following claims, and reserve the right to claim in the future any or all aspects of any innovation shown or described herein.

The invention claimed is:

1. An item of footwear comprising:

an upper comprising a first portion and a second portion; and an attachment system, comprising:

a buckle assembly comprising a clasp adapted to be coupled to the first portion of the upper, the clasp comprising an elongated portion having an integrated curved element, the integrated curved element including an at least partially spherical portion; and a receiver pivotally coupled to the second portion of the upper such that the receiver is movable between an open position and a closed position, the receiver comprising an elongated recess adapted to slidably receive the elongated portion, the elongated recess defining a socket adapted to house the at least partially spherical portion of the integrated curved element, wherein the elongated recess securely holds the elongated portion in a longitudinal direction of the attachment system, and wherein engagement between the socket and the integrated curved element facilitates pivotal movement of the clasp within the elongated recess in a transverse direction of the attachment system such that the first portion and the second portion secure the footwear to the wearer while facilitating relative movement in the transverse direction between the buckle assembly and the receiver;

wherein the at least partially spherical portion defines a depression configured to house a fastener that is positioned to attach the receiver to the second portion of the upper.

2. The item of footwear of claim 1, wherein the item of footwear is a motocross boot.

3. The item of footwear of claim 1, wherein a width of the integrated curved element forms a widest part of the clasp.

4. The item of footwear of claim 3, wherein the integrated curved element is positioned centrally along a width of the elongated portion such that pivotable surfaces extend from both sides of the elongated portion.

5. The item of footwear of claim 1, wherein the engagement between the socket and the integrated curved element facilitates pivotal movement of the clasp within the elongated recess about more than one axis.

6. The item of footwear of claim 1, wherein the integrated curved element and the elongated recess are adapted to allow the elongated portion to pivot up to 8 degrees in both transverse directions of the receiver around a central axis of the integrated curved element within the elongated recess.

7. The item of footwear of claim 1, wherein the elongated recess of the receiver defines an outwardly angled U-shape.

8. The item of footwear of claim 1, wherein the elongated recess of the receiver comprises a ridge positioned to hold the integrated curved element in the receiver allowing the integrated curved element to stay seated within the receiver even while the clasp is released.

9. The item of footwear of claim 1, further comprising an anchor that provides a pivotal engagement point for the receiver relative to the second portion of the upper.

10. A footwear, comprising:

an upper including a first portion and a second portion;

a buckle assembly coupled to the first portion of the upper, the buckle assembly including a clasp having (i) an elongated portion and (ii) a pivotable portion extending directly from the elongated portion and defining a depression;

a receiver pivotally coupled to the second portion of the upper such that the receiver is movable between an open orientation and a closed orientation, the receiver defining an elongated recess having a socket, the elongated recess configured to slidably receive the elongated portion of the clasp and the socket configured to receive the pivotable portion of the clasp; and a fastener positioned to secure the receiver to the second portion of the upper;

wherein the depression of the pivotal portion is configured to house the fastener while the clasp and the receiver are arranged in the closed orientation; and wherein engagement between the socket and the pivotable portion is configured to facilitate pivotal movement of the clasp within the elongated recess of the receiver while the clasp and the receiver are arranged in the closed orientation.

11. The footwear of claim 10, wherein the elongated recess is configured to securely hold the elongated portion in a longitudinal direction to prevent disengagement of the clasp from the receiver while the clasp and the receiver are arranged in the closed orientation.

12. The footwear of claim 11, wherein engagement between the socket and the pivotable portion is configured to facilitate pivotal movement of the clasp within the elongated recess in a transverse direction while the clasp and the receiver are arranged in the closed orientation.

13. The footwear of claim 12, wherein the pivotable portion and the elongated recess are configured to facilitate pivotal movement of the elongated portion up to 8 degrees in both transverse directions while in the clasp and the receiver are arranged in the closed orientation.

14. The footwear of claim 10, wherein a portion of the pivotable portion has a curved shape.

15. The footwear of claim 14, wherein the curved shape is at least one of hemi-spherical shaped and spherical shaped.

16. The footwear of claim 10, wherein the pivotable portion has a first width and the elongated portion has a second width less than the first width, and wherein the pivotable portion is positioned centrally along the second width of the elongated portion such the pivotable portion extends from both sides of the elongated portion.

17. The footwear of claim 10, wherein the elongated recess of the receiver has an outwardly angled U-shape.

* * * * *